US007887174B2

(12) United States Patent
Katada

(10) Patent No.: US 7,887,174 B2
(45) Date of Patent: Feb. 15, 2011

(54) LIQUID EJECTION APPARATUS AND GAS PROCESSING METHOD

(75) Inventor: Masahito Katada, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 841 days.

(21) Appl. No.: 11/892,782

(22) Filed: Aug. 27, 2007

(65) Prior Publication Data

US 2008/0049084 A1 Feb. 28, 2008

(30) Foreign Application Priority Data

Aug. 28, 2006 (JP) ..... 2006-230934

(51) Int. Cl.
*B41J 2/19* (2006.01)

(52) U.S. Cl. ..... 347/92

(58) Field of Classification Search ..... 347/54, 347/65, 66, 68, 92
See application file for complete search history.

(56) References Cited

U.S. PATENT DOCUMENTS

| | | | | |
|---|---|---|---|---|
| 4,393,384 | A * | 7/1983 | Kyser | 347/94 |
| 5,030,973 | A * | 7/1991 | Nonoyama et al. | 347/93 |
| 5,155,498 | A * | 10/1992 | Roy et al. | 347/11 |
| 5,872,583 | A * | 2/1999 | Yamamoto et al. | 347/70 |
| 6,224,201 | B1 | 5/2001 | Shigemura | |
| 2001/0017642 | A1 | 8/2001 | Shigemura | |

FOREIGN PATENT DOCUMENTS

| | | | |
|---|---|---|---|
| JP | 11-42795 | A | 2/1999 |
| JP | 2002-144604 | A | 5/2002 |
| JP | 2003-182116 | A | 7/2003 |

* cited by examiner

*Primary Examiner*—Anh T. N. Vo
(74) *Attorney, Agent, or Firm*—Birch, Stewart, Kolasch & Birch, LLP

(57) ABSTRACT

The liquid ejection apparatus includes a first liquid chamber which supplies liquid to pressure chambers of an ejection head; a gas flow channel which has a first end connected to an upper portion of the first liquid chamber and which forms a flow channel for gas to be expelled from the first liquid chamber; a second liquid chamber which accommodates the liquid and is separated from the first liquid chamber by means of a partition; a gas flow channel opening and closing device which opens and closes the gas flow channel so that the gas moves from the first liquid chamber to the second liquid chamber and is dissolved into the liquid accommodated in the second liquid chamber; a pressure control device which controls internal pressures of the ejection head in such a manner that an internal pressure of the second liquid chamber is less than an internal pressure of the first liquid chamber and controls the gas flow channel opening and closing device so that a bubble having a prescribed size is created at a bubble creation position, a bubble pressure measurement element measuring an internal pressure of the bubble present at the bubble creation position; and a gas judgment device which judges presence or absence of the gas in the first liquid chamber according to a measurement result of the bubble pressure measurement element.

8 Claims, 23 Drawing Sheets

FIG.22

| M \ N | 1 | | 2 | | ··· | $N_{max}$ | |
|---|---|---|---|---|---|---|---|
| | $P_{in}(N,M)$ | $P_{out}(M)$ | $P_{in}(N,M)$ | $P_{out}(M)$ | ··· | $P_{in}(N,M)$ | $P_{out}(M)$ |
| 1 | $P_{in}(1,1)$ | $P_{out}(1)$ | $P_{in}(2,1)$ | $P_{out}(1)$ | ··· | $P_{in}(N,1)$ | $P_{out}(1)$ |
| 2 | $P_{in}(1,2)$ | $P_{out}(2)$ | $P_{in}(2,2)$ | $P_{out}(2)$ | ··· | $P_{in}(N,2)$ | $P_{out}(2)$ |
| 3 | $P_{in}(1,3)$ | $P_{out}(3)$ | $P_{in}(2,3)$ | $P_{out}(3)$ | ··· | $P_{in}(N,3)$ | $P_{out}(3)$ |
| 4 | $P_{in}(1,4)$ | $P_{out}(4)$ | $P_{in}(2,4)$ | $P_{out}(4)$ | ··· | $P_{in}(N,4)$ | $P_{out}(4)$ |
| ⋮ | ⋮ | ⋮ | ⋮ | ⋮ | ··· | ⋮ | ⋮ |
| $M_{max}$ | $P_{in}(1,M_{max})$ | $P_{out}(M_{max})$ | $P_{in}(2,M_{max})$ | $P_{out}(M_{max})$ | ··· | $P_{in}(N,M_{max})$ | $P_{out}(M_{max})$ |

FIG.23

| SAMPLE NUMBER M | GAS PRESENT/ABSENT FLAG FOR GAS ACCUMULATING SECTIONS (1 TO $N_{max}$) | BUBBLE EXTINCTION FLAG FOR BUBBLE NOZZLES (1 TO $N_{max}$) |
|---|---|---|
| 1 | 1 | 1 |
| 2 | 0 | 0 |
| 3 | 0 | 1 |
| 4 | 0 | 0 |
| :<br>: | :<br>: | :<br>: |
| Mmax | 1 | 1 |
| REMARKS | 0:GAS ABSENT<br>1:GAS PRESENT | 0:GAS BUBBLE EXTINGUISHED<br>1:GAS BUBBLE NOT EXTINGUISHED |

LIQUID EJECTION APPARATUS AND GAS PROCESSING METHOD

BACKGROUND OF THE INVENTION

1. Field of the Invention

The present invention relates to a liquid ejection apparatus and a gas processing method, and more particularly, to the structure of an ejection head which ejects liquid droplets from nozzles, and to determination technology and processing technology for gas in an ejection head.

2. Description of the Related Art

An inkjet recording apparatus has been widely used as a recording apparatus which prints and records images that have been captured by a digital still camera, and the like. The inkjet recording apparatus includes a plurality of nozzles in a head, and records a prescribed image on a recording medium by ejecting ink droplets onto the recording medium from the nozzles. An inkjet recording apparatus with a line type head (full line head) corresponding to the breadthways dimension of the recording medium, has been known in which an image is printed on the whole surface of the recording medium while the line type head and a recording medium are moved relatively to each other, in a prescribed movement direction. In the inkjet recording apparatus of this type, a higher printing speed and improved productivity can be achieved in comparison with a serial method in which an image is printed on the whole surface of the recording medium by scanning the recording medium with the head (recording head) in the breadthways direction of the recording medium a plurality of times while causing the recording medium to be moved by a prescribed distance in a direction substantially perpendicular to the scanning direction of the head.

The full line head typically includes a single common liquid chamber for a plurality of nozzles and pressure chambers. If bubbles (which is also referred to as "gas" simply and which includes air bubbles, for example) that are generated in the common liquid chamber are incorporated into the pressure chambers and the nozzles, then ejection abnormalities may occur. Consequently, various technologies have been proposed for removing the gas incorporated in the common liquid chamber (or causing the gas to be dissolved into ink), and thereby preventing gas from infiltrating into the nozzles and the pressure chambers.

Japanese Patent Application Publication No. 11-42795 discloses a composition in which the ink inside the main tank is supplied by means of a main pump to a sub tank, the ink inside the sub tank is supplied to an inkjet head via a main deaeration device, a dissolved oxygen meter, a three-way valve, and the like, and if the value of the amount of dissolved oxygen in the liquid is high, then the three-way valve is switched in such a manner that the liquid in the sub tank is returned via a circulation path connected to the three-way valve, whereby bubbles and dissolved oxygen in the ink, which may cause ink ejection failures and ejection instabilities, are removed from the ink channel without wasting ink, and the bubbles and dissolved oxygen in the ink are thereby prevented from being incorporated into the inkjet head.

Japanese Patent Application Publication No. 2003-182116 discloses a composition in which the pressure value inside the ink supply channel is measured under conditions in which an ink supply channel from a recording head to an ink tube is closed by a valve device, and the pressure is reduced or raised, and a restoration operation is controlled in accordance with the volume of the bubbles accumulated inside the ink supply channel as estimated on the basis of this measurement result.

Japanese Patent Application Publication No. 2002-144604 discloses a composition in which the liquid ejection head includes piezoelectric elements of shear-mode type and a manifold that distributes liquid to the respective pressure chambers, and a voltage is applied between a common electrode formed on the piezoelectric element and an electrode formed in the manifold, and a value that depends on the presence or absence of air bubbles in the liquid is measured in accordance with the conductance caused by application of the voltage, the presence or absence of air bubbles being judged on the basis of this measurement result.

However, in the invention described in Japanese Patent Application Publication No. 11-42795, a dissolved oxygen meter is provided in an ink channel between the inkjet head and the sub tank, and the gas inside the inkjet head is determined indirectly on the basis of the value of this dissolved oxygen meter. In other words, the amount of dissolved gas inside the inkjet head is not measured directly. Since it is difficult to measure the amount of dissolved gas inside the inkjet head accurately, then in the composition disclosed in Japanese Patent Application Publication No. 11-42795, there is a concern that the dissolved gas may turn into bubbles as a result of temperature change inside the inkjet head, or the like, if liquid containing a large amount of dissolved gas is supplied to the inkjet head. Moreover, commonly known dissolved oxygen meters are constituted of consumable items, such as electrodes, separating films, an electrolyte, or the like, and replacement of these consumable items is required.

In the invention described in Japanese Patent Application Publication No. 2003-182116, a pressure measurement device which measures the pressure inside the ink supply channel is provided in the vicinity of an ink tank which is separated from the recording head, and the amount of gas inside the ink supply channel is estimated on the basis of the pressure of the ink supply channel in the vicinity of the ink tank. Therefore, it is difficult to accurately estimate the amount of gas in the ink inside the recording head (this measurement corresponds to determining the sum total of the volume of the bubbles inside the recording head and the ink supply channel). Furthermore, if the amount of gas thus estimated exceeds a threshold value, then a restoration operation of suctioning ink from the ejection ports is carried out in the recording head, and a large amount of ink is consumed when this restoration operation is performed.

The invention described in Japanese Patent Application Publication No. 2002-144604 determines a value which changes depending on the presence or absence of bubbles in the liquid, in accordance with the conductance produced by application of voltage between the common electrode formed on a diaphragm and the electrode formed inside the manifold, and hence there are concerns about decline in the determination accuracy. Cases may arise where a large error occurs in the determination value, depending on the composition of the determination circuit (the accuracy of the determination circuit). Moreover, if a bubble is detected, then a restoration operation is carried out by suctioning the ink via the nozzle holes, and therefore a large amount of ink is consumed when a restoration operation is carried out.

SUMMARY OF THE INVENTION

The present invention has been contrived in view of the aforementioned circumstances, an object thereof being to provide a liquid ejection apparatus and a gas processing method whereby the gas inside a common liquid chamber which supplies liquid to respective pressure chambers, as well as the amount of dissolved gas in the liquid inside the common liquid chamber, is determined with good accuracy, and furthermore, consumption of a large amount of ink is avoided in a restoration operation carried out when the gas occurs in the common liquid chamber.

In order to attain the aforementioned object, the present invention is directed to a liquid ejection apparatus, including: an ejection head which includes: pressure chambers storing liquid; nozzles which are connected with the pressure chambers and from which the liquid is ejected by means of pressure applied to the pressure chambers; a first liquid chamber which supplies the liquid to the pressure chambers; a gas flow channel which has a first end connected to an upper portion of the first liquid chamber and which forms a flow channel for gas to be expelled from the first liquid chamber; a second liquid chamber which accommodates the liquid and is separated from the first liquid chamber by means of a partition and which has a bubble nozzle connecting to a second end of the gas flow channel other than the first end, the gas being expelled from the first liquid chamber through the gas flow channel and the bubble nozzle and being to be dissolved into the liquid accommodated in the second liquid chamber; a gas flow channel opening and closing device which opens and closes the gas flow channel so that the gas moves from the first liquid chamber to the second liquid chamber; and a bubble pressure measurement element which is provided so as to correspond to a bubble creation position located in a vicinity of the bubble nozzle or inside the bubble nozzle; a pressure control device which controls internal pressures of the ejection head in such a manner that an internal pressure of the second liquid chamber is less than an internal pressure of the first liquid chamber; a gas flow channel opening and closing control device which controls the gas flow channel opening and closing device so that a bubble having a prescribed size is created at the bubble creation position, the bubble pressure measurement element measuring an internal pressure of the bubble present at the bubble creation position; and a gas judgment device which judges presence or absence of the gas in the first liquid chamber, according to a measurement result of the bubble pressure measurement element, wherein if it is judged by the gas judgment device that the gas is present in the first liquid chamber, then the gas flow channel opening and closing control device controls the gas flow channel opening and closing device so that the gas moves from the first liquid chamber to the second liquid chamber and is dissolved into the liquid accommodated in the second liquid chamber.

According to the present invention, since the internal pressure of the bubble created in a second liquid chamber is measured by means of the bubble internal pressure measurement element provided in the second liquid chamber, and since the presence or absence of gas inside the first liquid chamber is judged on the basis of the measurement results, then the reliability of gas determination (gas detection) is improved in comparison with indirect determination using a dissolved oxygen meter that is provided externally to the ejection head, and furthermore, there is no requirement to provide a determination device, such as a dissolved oxygen meter, or the like, externally to the ejection head.

Furthermore, if gas is present in the first liquid chamber, then the gas is dissolved into the liquid inside the second liquid chamber, and therefore no wasted liquid arises during the removal of gas from the first liquid chamber. Moreover, since there is virtually no variation in the internal pressure of the first liquid chamber while the gas inside the first liquid chamber is removed, then even in a state where the liquid is being ejected from the nozzles, it is still possible to remove the gas inside the first liquid chamber.

In order to improve the determination accuracy by restricting the measurement range of the bubble pressure measurement element, it is desirable that a bubble of a prescribed small size be created, and that the determination object be one bubble.

Here, the "bubble" created in the second liquid chamber indicates a bubble of small size which has been separated (divided off) from the gas, such as air, and which is present inside the liquid.

The second liquid chamber may be provided on the upper side of the first liquid chamber in terms of the vertical direction, or the first liquid chamber and the second liquid chamber may be provided in substantially parallel positions in the horizontal direction.

There is a mode in which the pressure control device includes a pressure generating unit (pressure generation device) connected to the second liquid chamber, and a control unit which controls and varies the pressure generated by the pressure generation device.

It is also possible to provide a liquid pressure measurement element which measures the pressure of the liquid inside the second liquid chamber, in such a manner that this liquid pressure measured by the liquid pressure measurement element is used to correct the internal pressure of the bubble measured by the bubble internal pressure measurement element.

If a flow of liquid is generated inside the second liquid chamber, then it is possible to improve the gas dissolution capacity. It is also possible to use the pressure control device as a device which generates a flow of liquid.

The liquid ejection apparatus includes an image forming apparatus (inkjet recording apparatus) which forms a desired image by ejecting ink onto the recording medium.

The present invention displays significant beneficial effects in a liquid ejection apparatus including a line type of ejection head having a nozzle row which corresponds to the breadthways direction of an ejection receiving medium which receives ejection of liquid. In other words, a line type ejection head typically includes a common liquid chamber (a first liquid chamber) of a large size which is common for all of the pressure chambers, and since there is a high probability that gas will arise in a large common liquid chamber of this kind, then it is necessary to remove the gas from the common liquid chamber, with good efficiency.

Preferably, the above-described liquid ejection apparatus further includes: a liquid movement flow channel which connects the first liquid chamber with the second liquid chamber and forms a flow channel for the liquid from the first liquid chamber to the second liquid chamber; and a movement flow channel opening and closing device which opens and closes the liquid movement flow channel.

In this aspect of the present invention, it is possible for the liquid in the first liquid chamber (in other words, the liquid to be ejected from the nozzles) to be mixed with the liquid in the second liquid chamber (in other words, the liquid in which the internal pressure of bubble is measured and into which the gas is to be dissolved). It is then possible to make the conditions in the first liquid chamber and the conditions in the second liquid chamber become similar (or the same).

Preferably, if it is judged by the gas judgment device that the gas is present in the first liquid chamber, then the gas flow channel opening and closing control device repeatedly opens and closes the gas flow channel opening and closing device, thereby dividing up the gas present in the first liquid chamber so that the divided gas moves from the first liquid chamber to the second liquid chamber and is dissolved into the liquid accommodated in the second liquid chamber.

According to this aspect of the present invention, since the gas inside the first liquid chamber is divided up and moved successively to the liquid in the second liquid chamber, by repeatedly opening and closing the gas flow channel opening and closing device. It is therefore possible to increase the internal pressure of the bubble (gas) moved to the second liquid chamber (by decreasing the size of the bubble). Moreover, by increasing the surface area of the bubble (gas) in contact with the liquid (by increasing the ratio of the area of the bubble that is exposed to the liquid, to the volume of the bubble), shortening of the dissolution time of this bubble (gas) can be expected.

It is possible to change the size of the bubbles by changing the time during which the gas flow channel opening and closing device is opened. Since the gas (bubble) dissolves into the liquid in a shorter time, the smaller the size of the bubble, then improved dissolution efficiency can be expected by shortening the time during which the gas flow channel opening and closing device is opened, and creating small bubbles in the second liquid chamber.

It is also possible to provide a dividing device which is capable of dividing up the gas, such as a filter, in either the first liquid chamber or the second liquid chamber.

Preferably, the liquid ejection apparatus further includes: a bubble internal pressure storage device which stores the internal pressure of the bubble measured by the pressure measurement element; a bubble change history calculation device which converts the internal pressure of the bubble stored in the bubble internal pressure storage device into a diameter of the bubble, and calculates a bubble change history which is a relationship between passage of time and change in the diameter of the bubble; a dissolved gas concentration calculation device which calculates concentration of dissolved gas in the liquid accommodated in the second liquid chamber, according to the bubble change history calculated by the bubble change history calculation device; and an expulsion device which expels the liquid in the ejection head to an exterior of the ejection head, when the concentration of dissolved gas in the second liquid chamber as calculated by the dissolved gas concentration calculation device exceeds a prescribed threshold concentration value.

According to this aspect of the present invention, since the concentration of dissolved gas in the liquid inside the second liquid chamber is calculated on the basis of the internal pressure of the bubble created in the second liquid chamber, then it is not necessary to provide a device for measuring the concentration of dissolved gas in the liquid inside the ejection head, such as a dissolved oxygen meter.

There is a mode where the expulsion device includes: an expulsion flow channel which is connected to the liquid expulsion section of the ejection head; and a pressure generation device which is connected to the expulsion flow channel and which generates a suctioning pressure in the liquid inside the ejection head. Moreover, a mode is also possible in which the above-described pressure control device (pressure generation section) is also used as a pressure generation device.

For a mode of ejecting liquid from the ejection head, it is possible to adopt a mode using a structure where the second liquid chamber and the expulsion flow channel are connected, and the liquid inside the second liquid chamber is expelled to the exterior of the ejection head, in addition to which, the liquid is moved from the first liquid chamber to the second liquid chamber, and liquid is supplied to the first liquid chamber from the exterior of the ejection head (from a liquid supply unit). Moreover, a mode is also possible in which the liquid inside the second liquid chamber is expelled to the exterior of the ejection head, in addition to which, the liquid inside the first liquid chamber is expelled to the exterior of the ejection head via the second liquid chamber, liquid is supplied to the second liquid chamber from the exterior of the ejection head (from a liquid supply unit) via the first liquid chamber, and furthermore, liquid is supplied to the first liquid chamber from the exterior of the ejection head (from the liquid supply unit).

Furthermore, the liquid inside the second liquid chamber may be expelled to the exterior of the ejection head, if the liquid in the second liquid chamber has reached (or approached) a saturated concentration of dissolved gas.

Preferably, the liquid ejection apparatus further includes: a deaeration device which carries out deaeration processing for the liquid expelled from the ejection head; and a circulation device which circulates the liquid having been subjected to the deaeration processing by the deaeration device, to the ejection head.

According to this aspect of the present invention, the liquid expelled from the ejection head in which the concentration of dissolved gas has become high is subjected to deaeration processing, and after deaeration processing, this liquid can be reused by being circulated back to the ejection head.

There is a mode where the circulation device includes a liquid supply unit which supplies liquid to the ejection head, and the circulation device sends the liquid after deaeration processing to a liquid supply tank and then circulates the deaerated liquid to the ejection head via the liquid supply unit.

There is a mode where the deaeration processing device includes a flow channel for liquid to be deaerated, a deaeration processing unit, and a flow channel for the liquid having been deareated. Moreover, it is also possible to provide a concentration of dissolved gas measurement device which measures the concentration of dissolved gas (amount of deaeration) in the deaeration processing unit, in such a manner that the liquid to be deaerated is subjected to deaeration processing until reaching a prescribed concentration of dissolved gas, while monitoring the measurement value of the concentration of dissolved gas measurement device.

Preferably, the first liquid chamber has a gas accumulating section in the upper portion of the first liquid chamber; a ceiling of the first liquid chamber is higher at the gas accumulating section than at other portions of the first liquid chamber; and the first liquid chamber is connected to the gas flow channel at an uppermost portion of the gas accumulating section.

According to this aspect of the present invention, it is possible to specify the location at which gas collects in the first liquid chamber, and therefore the reliability of gas determination is improved.

A desirable mode is one in which the gas accumulating section is provided in a position corresponding to the position where gas is liable to occur inside the first liquid chamber (for example, in the vicinity of a supply port connected to a pressure chamber), or a position where gas is liable to accumulate.

Preferably, the ceiling of the first liquid chamber is inclined at the gas accumulating section.

By forming the ceiling surface of the gas accumulating section to have an inclined surface, the gas moves readily to the uppermost portion of the gas accumulating section and improved accuracy in gas determination can be expected.

Moreover, in order to attain the aforementioned object, the present invention is also directed to a gas processing method for a liquid ejection apparatus including an ejection head having: nozzles which eject liquid; pressure chambers connected to the nozzles; a first liquid chamber which supplies the liquid to the pressure chambers; a gas flow channel which has a first end connected to an upper portion of the first liquid chamber and which forms a flow channel for gas to be expelled from the first liquid chamber; and a second liquid chamber which accommodates the liquid and is separated from the first liquid chamber by means of a partition and which has a bubble nozzle connecting to a second end of the gas flow channel other than the first end, the gas being expelled from the first liquid chamber through the gas flow channel and the bubble nozzle and being to be dissolved into the liquid accommodated in the second liquid chamber, the gas processing method comprising the steps of: controlling internal pressures of the ejection head in such a manner that an internal pressure of the second liquid chamber is less than an internal pressure of the first liquid chamber; creating a bubble of a prescribed size at a bubble creation position located in a vicinity of the bubble nozzle or inside the bubble nozzle; measuring an internal pressure of the bubble created in the step of creating the bubble; judging presence or absence of the gas in the first liquid chamber, according to a measurement result in the step of measuring the internal pressure of the bubble; and moving the gas from the first liquid chamber to the second liquid chamber so that the gas is dissolved into the liquid accommodated in the second liquid chamber, if it is judged, in the step of judging the presence or absence of the gas, that the gas is present in the first liquid chamber.

It is also possible to adopt a mode which includes the steps of: storing the internal pressure of the bubble measured in the step of measuring the internal pressure of the bubble; converting into the diameter of the bubble, the internal pressure of the bubble measured in the step of measuring the internal pressure of the bubble; calculating the history of change in the diameter of the bubble over the passage of time; and calculating a concentration of dissolved gas from the gas bubble change history calculated in the step of calculating the history of change in the diameter of the bubble.

According to the present invention, since the internal pressure of a bubble created in a second liquid chamber is measured by means of a bubble internal pressure measurement element provided in the second liquid chamber, and since the presence or absence of gas inside the first liquid chamber is judged on the basis of the measurement results, then the reliability of gas determination is improved in comparison with indirect determination made by means of a dissolved oxygen meter that is provided externally to the ejection head, and furthermore, there is no requirement to provide a determination device, such as a dissolved oxygen meter, or the like, externally to the ejection head.

Furthermore, if gas is present in the first liquid chamber, then the gas is dissolved into the liquid inside the second liquid chamber, and therefore no wasted liquid arises during the removal of gas from the first liquid chamber. Moreover, there is virtually no variation in the internal pressure of the first liquid chamber while the gas inside the first liquid chamber is removed, and even in a state where the liquid is being ejected from the nozzles, it is still possible to remove the gas inside the first liquid chamber.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 22 is a diagram showing an example of stored values for the internal pressure of the bubble and the pressure of the ink; and FIG. 23 is a diagram showing one example of a gas presence/absence flag and a bubble extinction flag.

DETAILED DESCRIPTION OF THE PREFERRED EMBODIMENTS

General Composition of Inkjet Recording Apparatus

Figure 1:
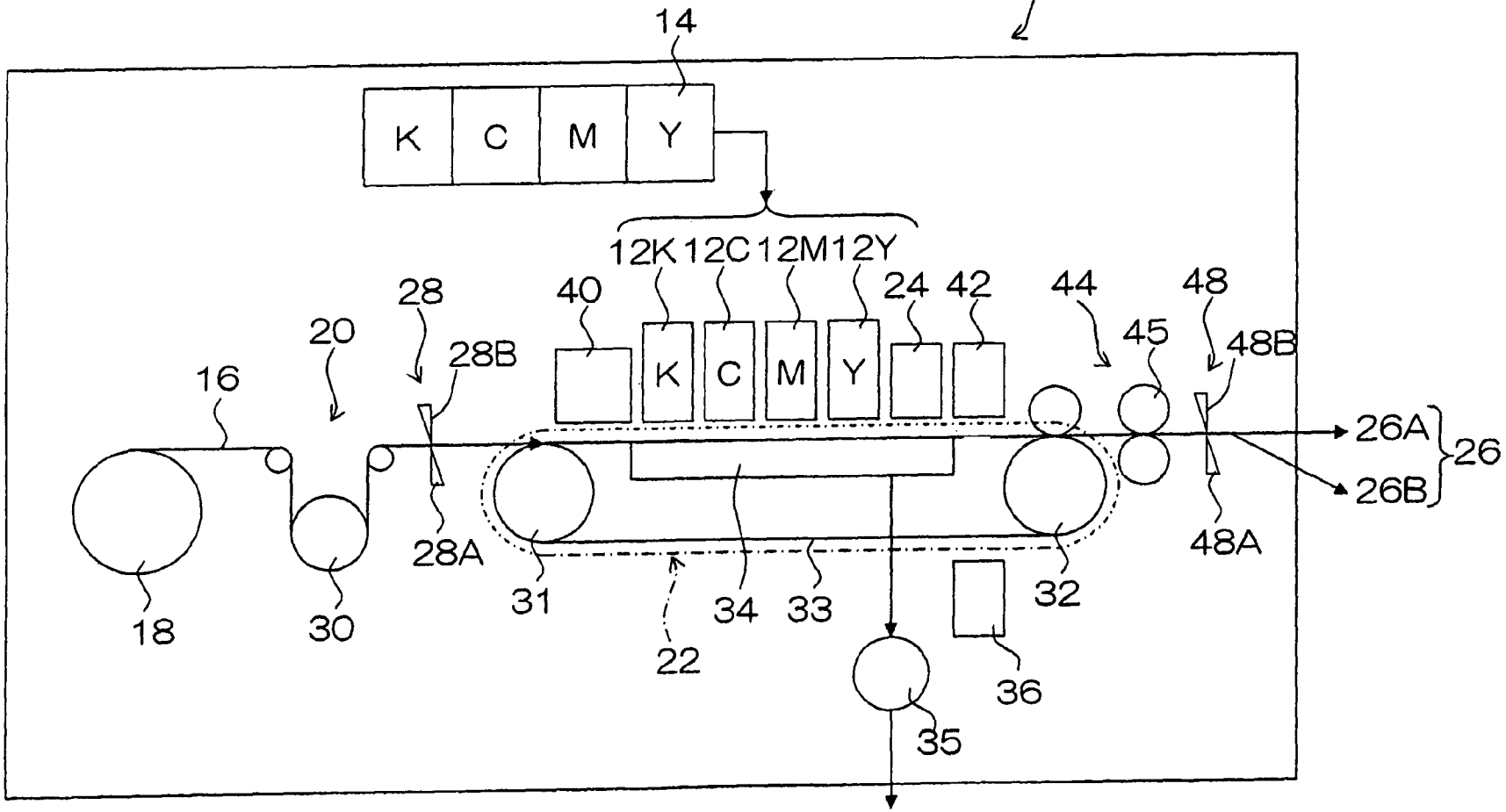
FIG. 1 is a basic schematic drawing of an inkjet recording apparatus according to an embodiment of the present invention.

FIG. 1 is a diagram of the general composition of an inkjet recording apparatus (liquid ejection apparatus) according to an embodiment of the present invention. As shown in FIG. 1, the inkjet recording apparatus 10 includes: a printing unit 12 having a plurality of print heads (ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face, not shown in FIG. 1) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

In the case of the configuration in which roll paper is used, a cutter (a first cutter) 28 is provided as shown in FIG. 1, and the roll paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

After decurling, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (a flat surface).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in FIG. 1, but shown as reference numeral 88 in FIG. 12) being transmitted to at least one of the rollers 31 and 32, which the belt 33 is set around, and the recording paper 16 held on the belt 33 is conveyed from left to right in FIG. 1. The belt 33 is explained in detail later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the printing area passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after being deposited on the paper.

Figure 2:
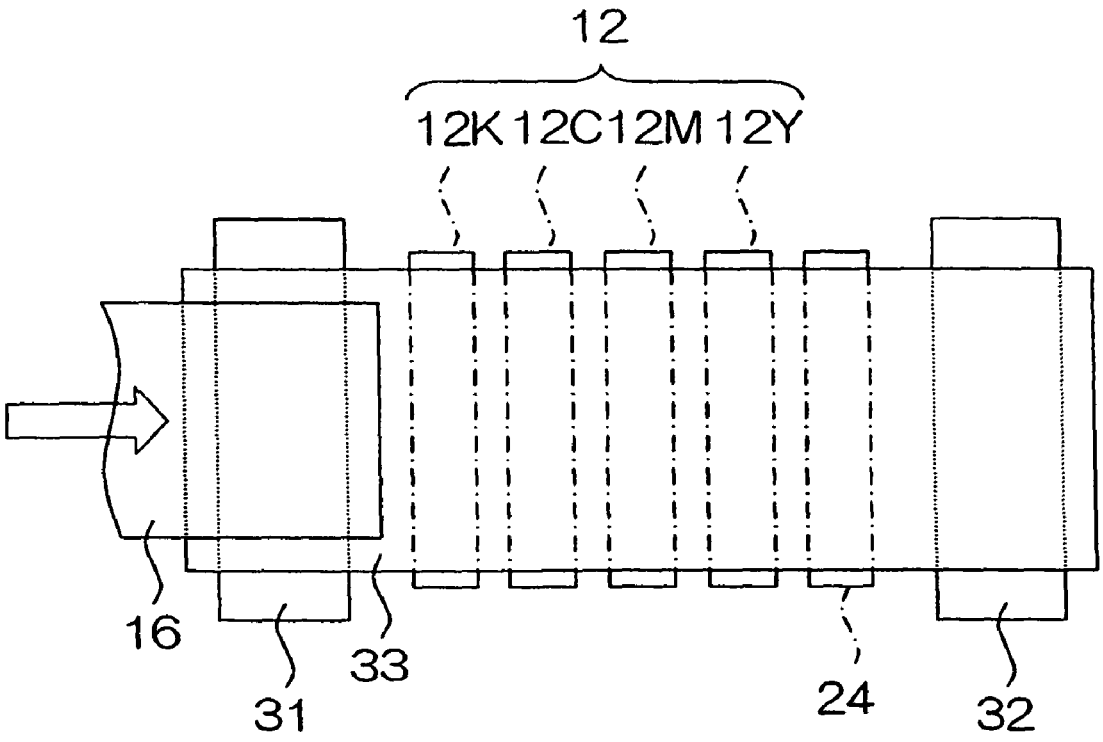
FIG. 2 is a plan view diagram showing the principal part of the peripheral printing region of the inkjet recording apparatus shown in FIG. 1.

The print unit 12 is a so-called "full line head" in which a line head having a length corresponding to the maximum paper width is arranged in a direction (main scanning direction) that is perpendicular to the paper feed direction (see FIG. 2). Each of the print heads 12K, 12C, 12M, and 12Y is constituted of a line head, in which a plurality of ink ejection ports (nozzles) are arranged along a length that exceeds at least one side of the maximum-size recording paper 16 intended for use in the inkjet recording apparatus 10, as shown in FIG. 2. An example of the structure of the head is described in detail below.

The print heads 12K, 12C, 12M, and 12Y are arranged in the order of black (K), cyan (C), magenta (M), and yellow (Y) from the upstream side, along the feed direction of the recording paper 16 (hereinafter, referred to as the paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K C M and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position. The print determination unit 24 is provided with a light source (not illustrated) to illuminate the dots on the recording paper.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders. Reference numeral 26B is a test print output unit.

Explanation on Print Head Structure

Next, the structure of a print head will be described. The print heads 12K, 12C, 12M and 12Y of the respective ink colors have the same structure, and a reference numeral 50 is hereinafter designated to any of the print heads.

Figure 3A:
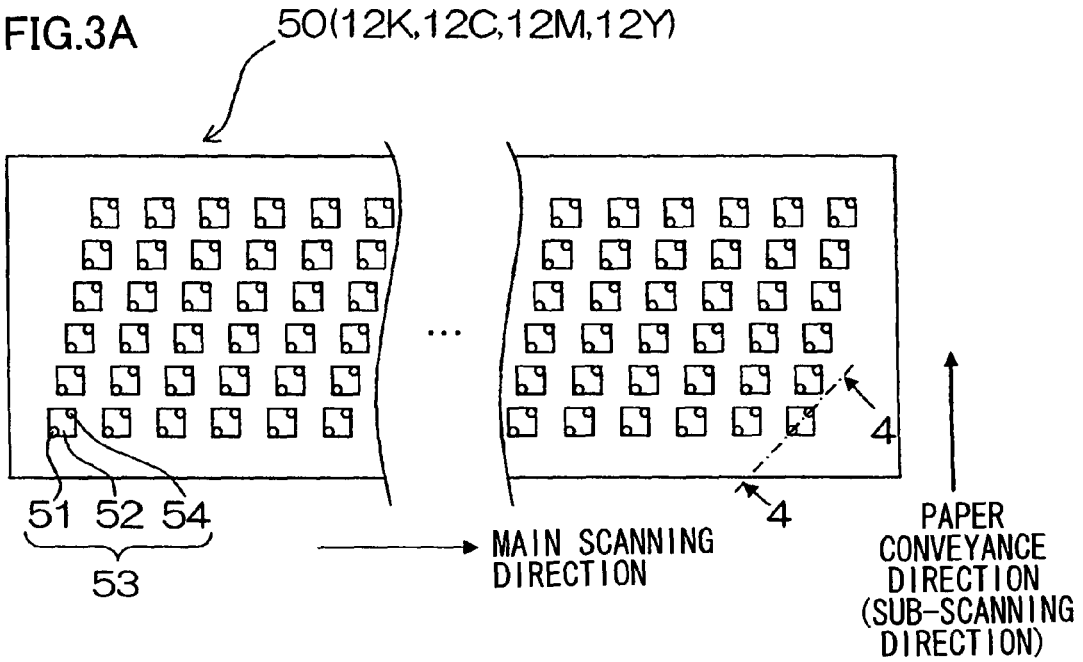
FIGS. 3A to 3C are plan view perspective diagrams showing examples of the composition of a print head.
Figure 3B:
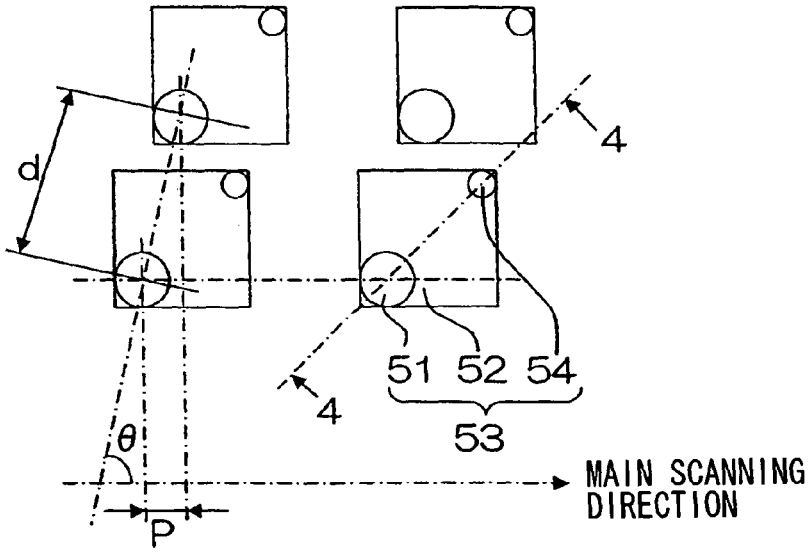
Figure 3C:
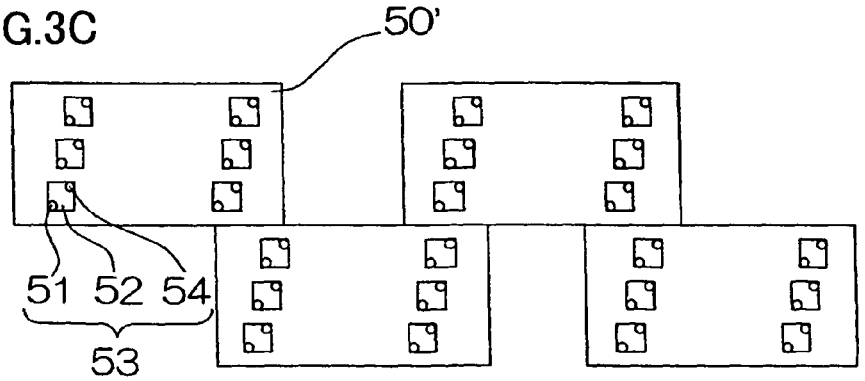

FIG. 3A is a plan view perspective diagram showing an example of the configuration of the print head 50, and FIG. 3B is its enlarged view. FIG. 3C is a plan view perspective diagram showing a further example of the structure of a print head 50. In order to achieve a high density of the dot pitch printed onto the surface of the recording medium, it is necessary to achieve a high density of the nozzle pitch in the print head 50. As shown in FIGS. 3A to 3C, the print head 50 according to the present embodiment has a structure in which a plurality of ink chamber units 53, each including a nozzle 51 from which ink is ejected and a pressure chamber 52 connecting to the corresponding nozzle 51, are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction (paper conveyance direction) of the recording medium.

Moreover, as shown in FIG. 3C, it is also possible to use respective heads 50' of nozzles arranged to a short length in a two-dimensional fashion, and to combine same in a zigzag arrangement, whereby a length corresponding to the full width of the print medium is achieved. Furthermore, although not shown in the drawings, it is also possible to connect short heads in a linear fashion.

As shown in FIGS. 3A to 3C, the pressure chamber 52 provided corresponding to each of the nozzles 51 is approximately square-shaped in plan view, and a nozzle 51 and a supply port 54 are provided respectively at either corner of a diagonal of the pressure chamber 52. Moreover, the respective pressure chambers 52 are connected via supply ports 54 to an integrated common liquid chamber 55 (first liquid chamber) which is common to the respective pressure chambers (FIG. 4A).

As shown in FIG. 3B, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure in which a plurality of ink chamber units 53 are arranged at a uniform pitch d in a direction having an angle $\theta$ with respect to the main scanning direction, the pitch P of the nozzles projected so as to align in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head having rows of nozzles corresponding to the entire width of the recording paper, the "main scanning" is defined as printing a line formed of a row of dots, or a line formed of a plurality of rows of dots in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIGS. 3A to 3C are driven, the main scanning according to the above-described (3) is preferred. On the other hand, "sub-scanning" is defined as to repeatedly perform printing of a line (a line formed of a row of dots, or a line formed of a plurality of rows of dots) formed by the main scanning, while moving the full-line head and the recording paper relatively to each other.

In other words, "main scanning" is the action of driving the nozzles so as to print a line constituted by one row of dots, or a plurality of rows of dots, in the breadthways direction of the paper, and "sub-scanning" is the action of repeating the printing of a line constituted by one row of dots or a plurality of rows of dots formed by main scanning. When implementing the present invention, the arrangement of the nozzles is not limited to that of the example illustrated.

Figure 4:
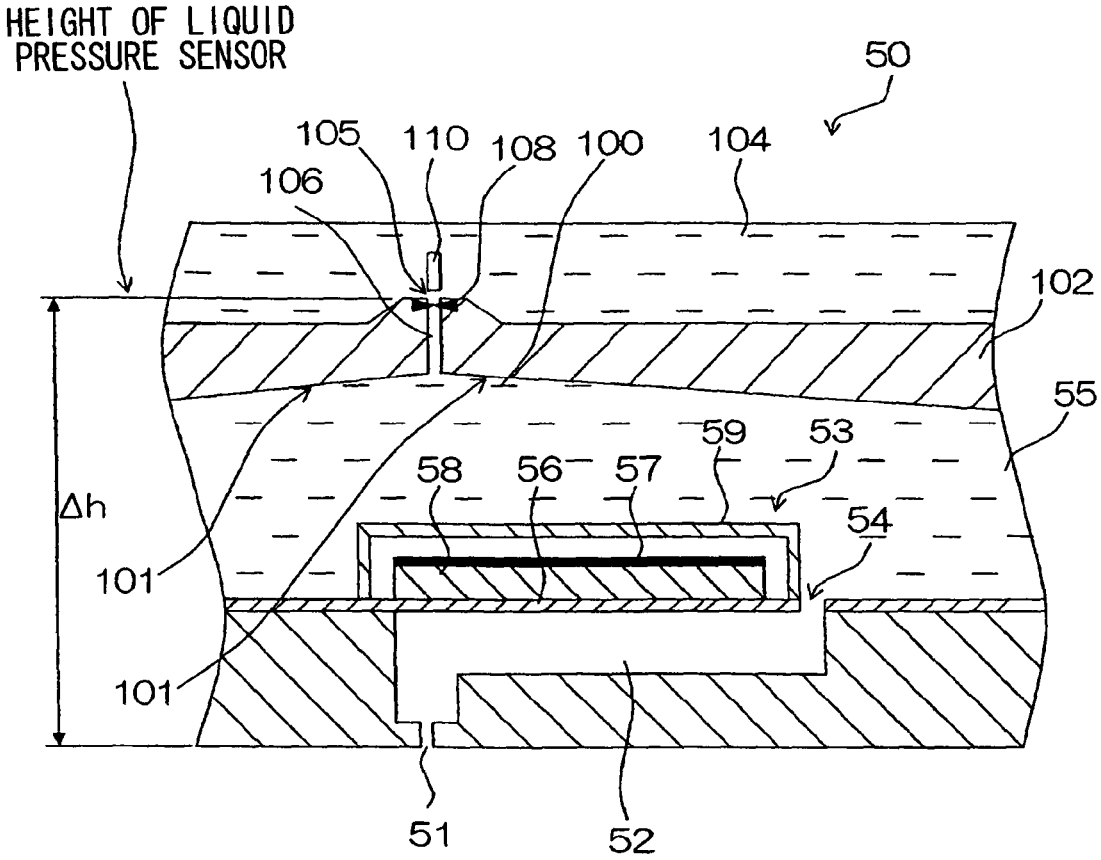
FIG. 4 is a cross-sectional diagram showing the three-dimensional structure of the print head.

FIG. 4 is a cross-sectional diagram showing the three-dimensional structure of the print head 50 (the ink chamber unit 53 shown in FIGS. 3A to 3C) (namely, a cross-sectional diagram along line 4-4 in FIGS. 3A and 3B). A piezoelectric element 58 provided with an individual electrode 57 is bonded to the diaphragm 56 which constitutes the ceiling of the pressure chambers 52, and the diaphragm 56 also functions as a common electrode for the piezoelectric elements 58. By applying a drive voltage to the individual electrode 57, a bending deformation is applied to the piezoelectric element 58, the pressure chamber 52 is deformed, and ink is thereby ejected from the nozzle 51. When ink is ejected from the nozzle, the piezoelectric element 58 transits from a deformed state to a static state, and new ink is supplied to the pressure chamber 52 from the common flow chamber 55, via the supply port 54.

The print head 50 according to the present embodiment has a rear surface flow channel structure in which ink is supplied to the pressure chambers 52 from a unified common liquid chamber 55 provided on the rear surface side of the pressure chambers 52 (the upper side in the vertical direction). In other words, the print head 50 has a structure in which the pressure chambers 52 are connected to the common liquid chamber 55, which is arranged across the diaphragm 56 from the pressure chambers 52, through supply ports 54. The supply ports 54 are provided in the diaphragm 56, and the supply ports 54 have a flow channel length which is substantially the same as the thickness of the diaphragm 56. In a rear surface flow channel structure of this kind, it is possible to shorten the flow channel length between the nozzle 51 and the pressure chamber 52 (the flow channel length of the ejection side flow channel), as well as the flow channel length (the flow channel length of the supply side flow channel) of the supply port 54 (supply side restrictor), in comparison with another structure (for example, a structure in which the common liquid chamber 55 is provided on the nozzle 51 side of the pressure chambers 52). It is therefore possible to reduce the flow channel resistance of the ejection side flow channels and the supply side flow channels, as well as being able to arrange the ink chamber units 53 at a high density. Consequently, in a head where a plurality of nozzles 51 are arranged at high density, a structure is achieved which makes it possible to increase the ejection frequency and to shorten the refilling cycle. In particular, a structure is achieved which is beneficial in a case where ink of high viscosity is ejected at a high ejection frequency of several ten kilohertz (kHz) to approximately one hundred kilohertz.

If the rear surface flow channel structure shown in FIG. 4 is adopted, then since piezoelectric elements 58 are provided on the side of the diaphragm 56 adjacent to the common liquid chamber 55 (inside the common liquid chamber 55), a cover member 59 which covers the piezoelectric elements 58 is provided in such a manner that the ink inside the common liquid chamber 55 does not make contact with the piezoelectric elements 58. Moreover, in a mode where wires (not shown) which transmit the drive signals to be supplied to the piezoelectric elements 58 are provided on the side of the diaphragm 56 adjacent to the common liquid chamber 55, a prescribed insulating process is carried out with respect to the wires.

Furthermore, although not shown in the drawings, it is also possible to adopt a mode in which wire members transmitting drive signals to be supplied to the piezoelectric elements 58 pass at least partially through the common liquid chamber 55. In other words, pads that are extracted from the individual electrodes 57 on the piezoelectric elements 58, are formed on the piezoelectric element arrangement surface of the diaphragm 56, and vertical wires are formed so as to rise up in a vertical direction from these pads, and these vertical wires are connected to the wiring pattern of a wiring substrate which is provided on the ceiling face of the common liquid chamber 55 (for example, the partition 102 in FIG. 4) and which is formed with a wiring pattern that is connected with the drive signal generating unit (the head driver 84 in FIG. 12). These vertical wires are formed in all regions (all the region where the piezoelectric elements 58 are disposed) of the common liquid chamber 55 so as to rise up through the common liquid chamber 55, and they function as supporting members which support the ceiling face. An insulating process is carried out on the surface of the vertical wiring members (the surface which makes contact with the ink).

In the present embodiment, a method is adopted in which ink is pressurized by the deformation of a piezoelectric element 58 (such as a piezoelectric element typically used in the related art). In implementing the present invention, it is also possible to use an actuator other than a piezoelectric element (for example, a heater which produces bubbles inside the pressure chamber 52), in place of the piezoelectric element 58.

A gas accumulating section 100 that includes an inclined section 101 having an inclination with respect to the horizontal surface, is provided in the ceiling face of the common liquid chamber 55. The ceiling of the gas accumulating section 100 of the common liquid chamber 55 is formed to be higher than the ceiling of the other portions of the common liquid chamber 55. The gas inside the common liquid chamber 55 collects in this gas accumulating section 100 due to the force of buoyancy. FIG. 4 shows just one gas accumulating section 100, but a desirable mode is one in which a plurality of gas accumulating sections 100 are provided in positions where the gas is liable to collect (for example, gas accumulating sections 100 are provided in equal number to the supply ports 54, at positions directly above the supply ports 54).

The print head 50 shown in FIG. 4 has a gas expulsion chamber 104 (second liquid chamber) which is separated from the common liquid chamber 55 by means of a partition 102 that is provided on the side of the common liquid chamber 55 opposite to the diaphragm 56 (the upper side in the vertical direction). This gas expulsion chamber 104 has a structure whereby it is connected to the common liquid chamber 55 by means of an ink movement flow channel (liquid movement flow channel; not shown in FIG. 4 and denoted with reference numeral 112 in FIG. 5), and the gas expulsion chamber 104 is filled with ink moved from the common liquid chamber 55 via this ink movement flow channel.

It is also possible to dispense with the ink movement flow channel, and to provide a supply device (a supply tank and a supply pressure generation device) which is capable of supplying ink from an external source, independently from the common liquid chamber 55. If a supply device is provided externally, then the liquid supplied to the gas expulsion chamber 104 may be a liquid other than ink.

A plurality of bubble nozzles 105 which connect to the gas accumulating sections 100 are formed in the bottom face of the gas expulsion chamber 104 (the side of the partition 102), and each bubble nozzle 105 is connected to one end of a gas flow channel 106 which connects the gas expulsion chamber 104 with the common liquid chamber 55. Furthermore, the other end of each gas flow channel 106 is provided on the ceiling face of the common liquid chamber 55 and is connected to the uppermost portion of the gas accumulating section 100 where the gas inside the common liquid chamber 55 is accumulated.

The gas flow channels 106 are provided extending in the vertical direction, and are each constituted of a straight channel (a linear channel) which has a prescribed diameter and does not contain any curves. Furthermore, a gas flow channel valve 108 which opens and closes the gas flow channel 106 is provided in the gas flow channel 106 at the immediate vicinity of the bubble nozzle 105 (namely the uppermost portion of the gas flow channel, in the vicinity of the end portion of the gas flow channel 106 on the side adjacent to the corresponding bubble nozzle).

The gas flow channel valve 108 shown in FIG. 4 is a control valve which is controlled via a valve control unit (reference numeral 202 in FIG. 12), and it is constituted in such a manner that, of the plurality of gas flow channels 106, one or a plurality of gas flow channels 106 can be opened and closed selectively.

In the inkjet recording apparatus 10 according to the present embodiment, in a state where at least the gas flow channel valve 108 is open, the internal pressure of the gas expulsion chamber 104 and the common liquid chamber 55 is controlled in such a manner that the internal pressure of the gas expulsion chamber 104 becomes less than the internal pressure of the common liquid chamber 55 (namely, in such a manner that the following conditions are met: internal pressure of gas expulsion chamber 104<internal pressure of common liquid chamber 55). In other words, if the gas expulsion chamber 104 is set to a negative pressure with respect to the internal pressure of the common liquid chamber 55, and the gas flow channel valve 108 is opened, then the gas accumulated in the gas accumulating section 100 of the common liquid chamber 55 can be moved via the gas flow channel 106, into the gas expulsion chamber 104.

In the print head 50 having the structure shown in FIG. 4, by closing the gas flow channel valve 108 after it has been opened for a prescribed period of time, it is possible to create a bubble (e.g., to create a small bubble by dividing up the gas accumulated in the gas accumulating section 100) at a bubble creation position (not shown in FIG. 4 and indicated by reference numeral 142 in FIG. 8A), in the vicinity of the bubble nozzle 105 or inside the bubble nozzle 105.

If the opening time period of the gas flow channel valve 108 is changed, then the size of the bubble created at the bubble creation position can be altered, and for example, if the opening time period of the gas flow channel valve 108 is lengthened, then the size of the bubble becomes relatively larger, whereas if the opening time period of the gas flow channel valve 108 is shortened, then the size of the bubble becomes relatively smaller. Moreover, by providing the gas flow channel valve 108 at the immediate vicinity of the bubble nozzle 105, the length of the gas flow channel above the gas flow channel valve 108 is shortened, and therefore it is possible to separate the bubble created in the bubble nozzle 105 and the gas inside the gas flow channel 106, reliably.

A bubble pressure sensor 110 which measures the internal pressure of the bubble created at the gas bubble creation position is provided inside the gas expulsion chamber 104 so as to correspond to the bubble creation position described above, and furthermore, a liquid pressure sensor which measures the pressure of the ink accommodated in the gas expulsion chamber 104 (not shown in FIG. 4; indicated by reference numeral 111 in FIG. 5) is also provided. As described in detail below, the presence or absence of the gas in the common liquid chamber 55 is judged on the basis of the measurement result of the bubble pressure sensor 110, and furthermore, the concentration of the gas dissolved in the gas expulsion chamber 104 is also calculated. Moreover, the measurement result of the bubble pressure sensor 110 is corrected on the basis of the pressure of the ink measured by the liquid pressure sensor.

The gas (dissolved gas) which has dissolved in the liquid stored in the common liquid chamber 55 may turn into bubbles due to temperature variation inside the print head 50, and the bubbles may occur in the ink inside the common liquid chamber 55. Moreover, bubbles may infiltrate into the print head 50, from the exterior, via the nozzles 51 and the ink supply system (see FIG. 7). The bubbles (gas) generated inside the common liquid chamber 55 in this way have the property of being readily movable in the upward vertical direction in the common liquid chamber 55, due to the inherent buoyancy of the gas, and therefore the gas (bubbles) accumulates in the uppermost portion of the gas accumulating section 100 along the oblique sections 101 of the gas accumulating section 100.

In the present specification, the gas present in the ink which has not dissolved in the ink (including the gas in the form of bubbles present at the ink-atmosphere interface) is referred to as a "bubble", but in cases where a clear distinction between bubbles and gas cannot be made, then the term "gas" may be used instead of "bubble".

Next, bubble determination according to the present embodiment will be described in detail. When the gas flow channel valve 108 is closed after being left open for a prescribed period of time, one bubble having a prescribed size (a bubble 142 forming a determination object, see FIG. 8A), which has been separated from the gas (reference numeral 140 in FIG. 8A) inside the gas accumulating section 100 via the gas flow channel 106 and the bubble nozzle 105, is created at the bubble creation position in the vicinity of the bubble nozzle 105 or inside the bubble nozzle 105, and the internal pressure $P_{in}$ of this bubble forming the determination object is measured by the bubble pressure sensor 110.

Furthermore, the pressure value $P_{out}$ of the ink accumulated in the gas expulsion chamber 104 is measured by the liquid pressure sensor, and a pressure differential $P_b$ ($=P_{in}-P_{out}$) of the bubble is calculated (the differential between the pressure value $P_{in}$ measured by the bubble pressure sensor 110 and the pressure value $P_{out}$ measured by the liquid pressure sensor is calculated; hereinafter, also referred to as "internal pressure of the bubble" that has been corrected according to the liquid pressure). The presence or absence of the gas inside the common liquid chamber 55 is judged on the basis of this pressure differential $P_b$ between the inside and the outside of the bubble.

If it is judged that the gas is present in the common liquid chamber 55 (it is judged that the gas is present in a particular gas accumulating section 100), then the opening and closing of the gas flow channel valve 108 in the gas flow channel 106 corresponding to that gas accumulating section 100 where the gas is accumulated is controlled in such a manner that the gas in that gas accumulating section 100 is gradually moved into the gas expulsion chamber 104 (by being divided up into small-sized bubbles). Consequently, the divided bubbles are made to dissolve into the liquid (ink) accommodated in the gas expulsion chamber 104.

It is also possible to adjust the back pressure of the print head 50 on the basis of the pressure value $P_{out}$ measured by the liquid pressure sensor, in a state where the ink movement flow channel valve (not shown in FIG. 4, and indicated by reference numeral 114 in FIG. 5) is open, the ink movement flow channel valve being provided in the ink movement flow channel (not shown in FIG. 4, and indicated by reference numeral 112 in FIG. 5), which connects the common liquid chamber 55 with the gas expulsion chamber 104. The pressure $P_{out}$ can be converted into a pressure value acting on the nozzle 51, as described in the following. The pressure $P_n$ acting on the nozzle 51 is expressed by the following equation:

$$P_n=P_{out}+(\rho\times g\times\Delta h),$$

where $P_{out}$ is the pressure of the ink inside the gas expulsion chamber 104, ρ is a density of the ink, g is the acceleration due to gravity, and Δh is a height differential between the measurement section of the liquid pressure sensor and the opening section of the nozzle 51 (the differential between the height of the liquid pressure sensor and the height of the opening section of the nozzle 51).

Figure 5:
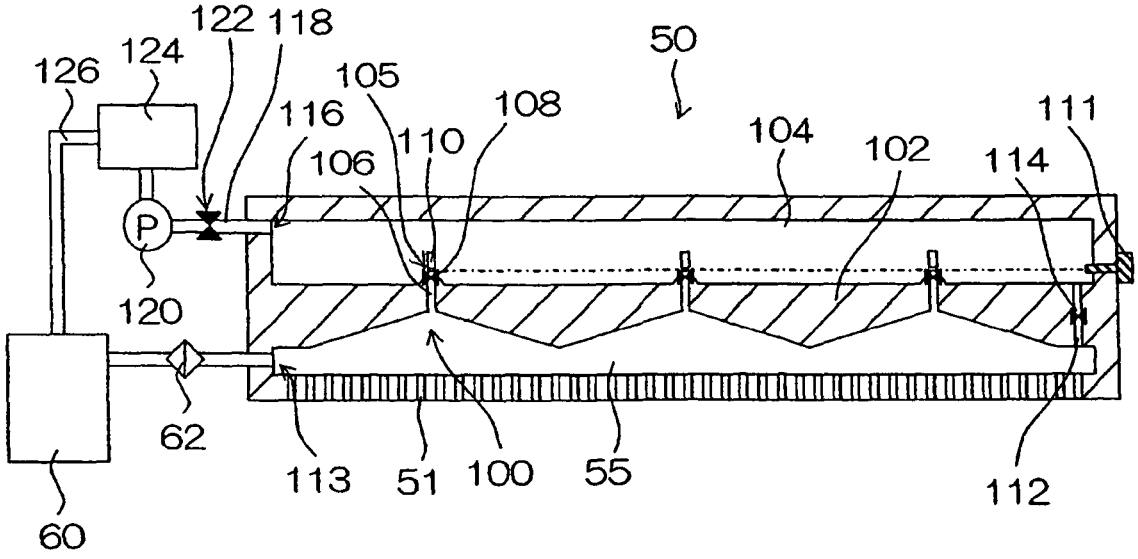
FIG. 5 is a cross-sectional diagram showing the three-dimensional structure of the print head and the composition of the ink circulation system.
Figure 7:
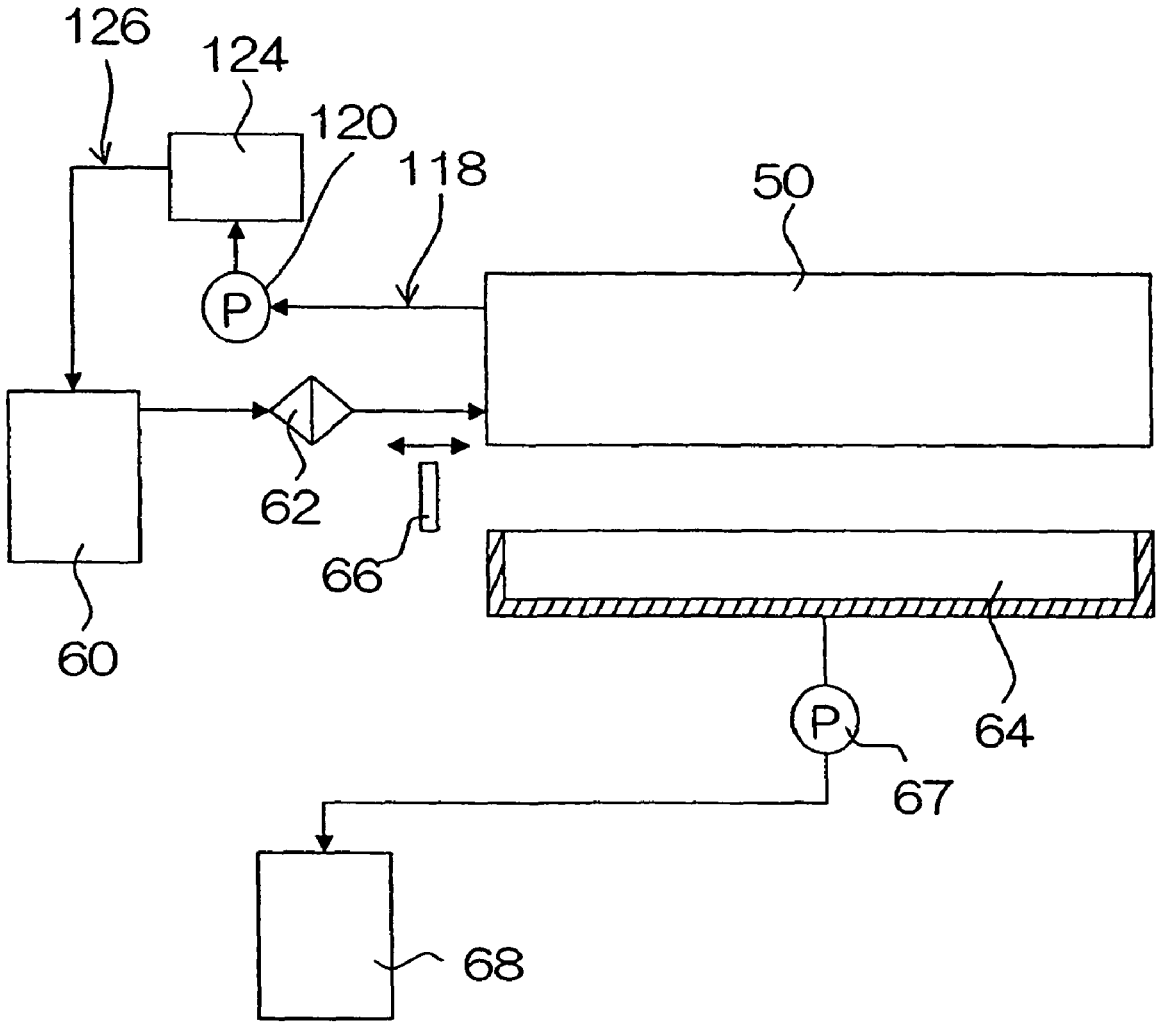
FIG. 7 is a principal diagram showing the composition of an ink supply system of the inkjet recording apparatus shown in FIG. 1.

FIG. 5 is a diagram showing an approximate view of the general structure of the print head 50, and the composition of a portion of an ink supply system which supplies ink to the print head 50 (the general composition of the ink supply system is shown in FIG. 7). In FIG. 5, the pressure chambers 52 and the supply ports 54 (see FIG. 4) connecting to the common liquid chamber 55 are not depicted.

As shown in FIG. 5, the print head 50 includes an ink inlet port 113 through which ink is introduced from the ink supply tank 60, and ink is introduced via a filter 62 and the ink inlet port 113 from the ink supply tank 60. As shown in FIG. 4, the print head 50 according to the present embodiment has a two-layer liquid chamber structure in which the gas expulsion chamber 104 and the common liquid chamber 55 are demarcated with the partition 102 (the gas expulsion chamber 104 is arranged on the upper side of the common liquid chamber 55, in the vertical direction).

At least one liquid pressure sensor 111 is provided in such a manner that it is inserted into a wall which constitutes the gas expulsion chamber 104, and the measurement section of the liquid pressure sensor 111 makes contact with the ink inside the gas expulsion chamber 104. The whole of the liquid pressure sensor 111 may be arranged on the inner wall of the gas expulsion chamber 104.

A desirable mode is one in which the measurement section of the liquid pressure sensor 111 is provided at the same height as the height where the opening section of the bubble nozzle 105 is formed. If the measurement section of the liquid pressure sensor 111 is provided at a height different from that of the opening section of the bubble nozzle 105, then a pressure differential is applied to the ink due to the difference between the height of the measurement section of the liquid pressure sensor 111 and the height of the bubble nozzle 105, and therefore a calculation for compensating for this pressure differential is required.

A fiber-optic system is suitable for use as the liquid pressure sensor 111 according to the present embodiment, but it is also possible to use a pressure sensor that is generally used, such as one based on a diaphragm system.

FIG. 5 depicts three gas accumulating sections 100, but it is also possible to provide one gas accumulating section 100, or a plurality of gas accumulating sections 100 in the common liquid chamber 55. For example, it is also possible to provide gas accumulating sections 100 in equal number to the supply ports 54, or to divide the common liquid chamber 55 into a plurality of blocks and to provide a gas accumulating section 100 for each respective block. Moreover, a desirable mode is one in which the gas accumulating sections 100 are provided in the regions where the gas is liable to occur in the common liquid chamber 55, such as directly above the supply ports 54, for instance.

Figure 6A:
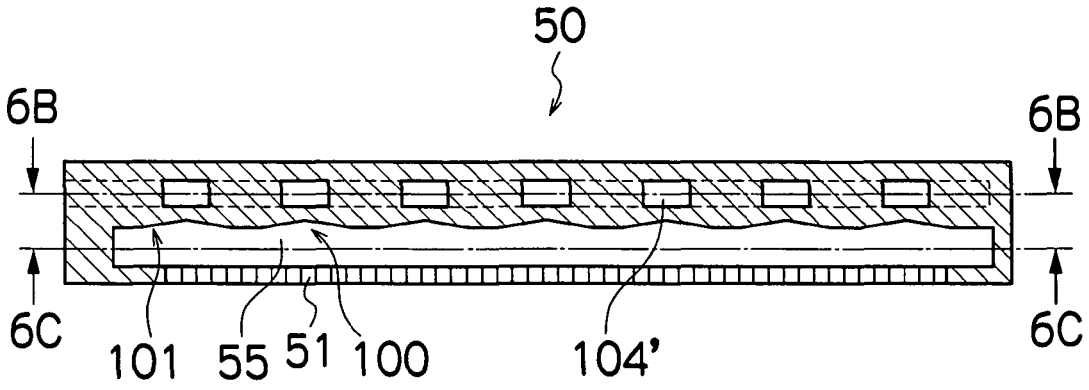
FIGS. 6A to 6C are diagrams showing a further example of the arrangement of gas accumulating sections and a gas expulsion chamber in FIG. 5.
Figure 6B:
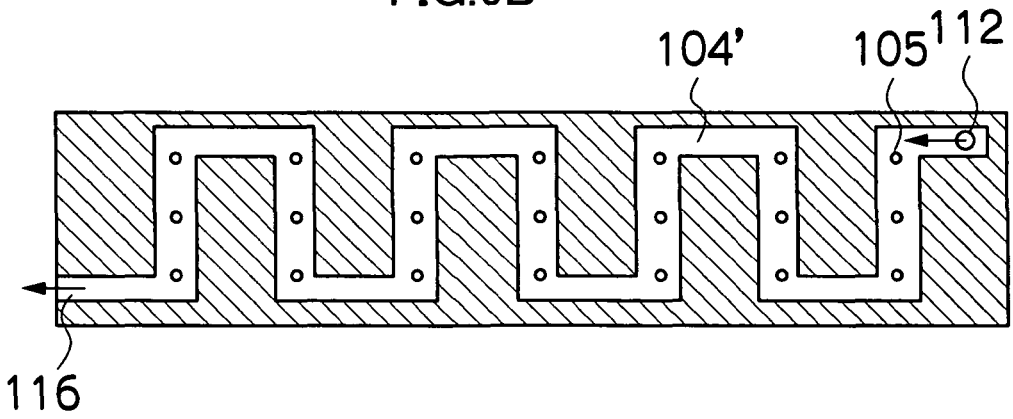
Figure 6C:
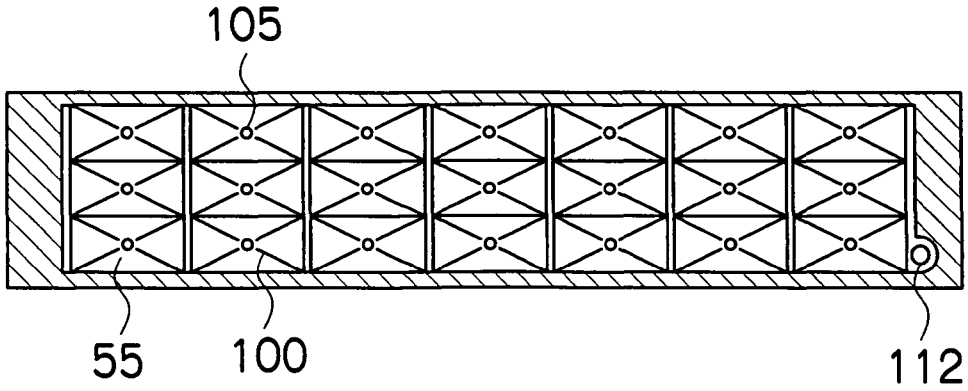

FIGS. 6A to 6C are diagrams showing an example of the arrangement of gas accumulating sections 100. FIG. 6A is a general cross-sectional diagram showing the structure of the print head 50 according to this arrangement example, and FIGS. 6B and 6C are cross-sectional diagrams along the lines 6B-6B and 6C-6C in FIG. 6A. In FIGS. 6A to 6C, the composition of a portion of the print head 50, such as the gas flow channel valve 108, and the like, shown in FIGS. 4 and 5, is omitted.

In a matrix type of print head in which the nozzles 51 are arranged in a two-dimensional arrangement, as shown in FIG. 3A, a desirable mode is one in which the bubble nozzles 105 are arranged two-dimensionally as shown in FIG. 6C, in accordance with the arrangement of the nozzles. Moreover, in the print head of matrix type, a composition is preferably adopted in which the gas accumulating sections 100 having the same shape and the same size are arranged two-dimensionally in accordance with the bubble nozzles 105, in the common liquid chamber 55 that extends two-dimensionally. This composition is preferable since the angle of inclination of the inclined sections 101 of the gas accumulating sections can be increased, and therefore the gas is caused to collect more readily in the uppermost sections of the gas accumulating sections 100.

FIG. 6C shows an example in which the gas accumulating section 100 has a rectangular planar shape, but the planar shape of the gas accumulating section 100 is not limited to a quadrilateral shape, such as a rectangular shape, and it is also possible to adopt a circular shape (or an oval shape) or a polygonal shape other than a quadrilateral shape, such as a triangular shape. Moreover, if the planar shape of the gas accumulating section 100 is a circular shape, then the gas accumulating section 100 will have a circular conical shape, and if the planar shape of the gas accumulating section 100 is a triangular shape, then the gas accumulating section 100 will have a triangular pyramid shape.

In FIG. 6B, a gas expulsion chamber 104' has the structure of a flow channel which includes a narrow flow channel that passes through the respective bubble nozzles 105 in a winding (serpentine) path (a flow channel structure which alternately combines a flow channel extending in the lengthwise direction of the print head 50 and a flow channel extending in the breadthways direction of the print head 50 (or an oblique direction that is coincide with the direction of arrangement of the nozzles 51)). Since the overall volumetric capacity and the width (cross-sectional area) of the gas expulsion chamber is small in the composition as shown in FIG. 6B, then it is possible to increase the flow speed of the ink inside the gas expulsion chamber, in comparison with a case where a gas expulsion chamber 104 having a unified structure is provided as shown in FIG. 5, and therefore the ink can be substituted (replaced with new one) more quickly.

Figure 12:
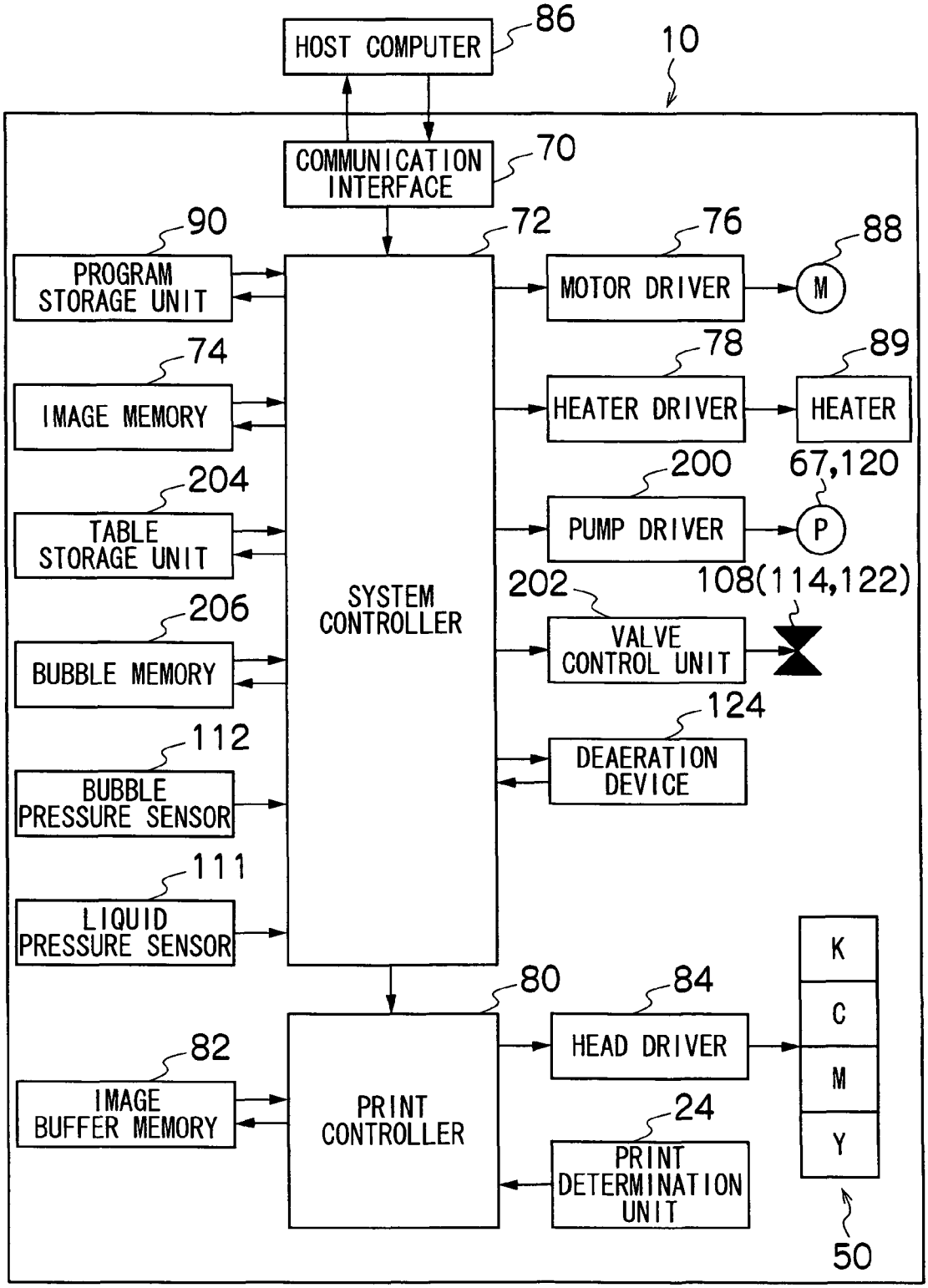
FIG. 12 is a principal block diagram showing the system configuration of the inkjet recording apparatus shown in FIG. 1.

In a mode where a plurality of gas accumulating sections 100 are provided, and a plurality of gas flow channels 106, bubble nozzles 105 and gas flow channel valves 108 are provided in a one-to-one correspondence with the gas accumulating sections 100, it is preferable to selectively open and close the gas flow channel valves 108, by judging whether or not the gas (if any) in each gas accumulating section 100 is required to be expelled. Therefore, control valves (valves which is configured to be opened and closed under the control of a valve control unit 202 as shown in FIG. 12) are used for the gas flow channel valves 108.

The upper surface of the end portion of the common liquid chamber 55, on the opposite side to the ink inlet port 113 in the lengthwise direction of the common liquid chamber 55, is connected to one end portion of the ink movement flow channel 112, which is a linear flow channel free of any curves provided following in the vertical direction, and the other end of the ink movement flow channel 112 is connected to the bottom face of the gas expulsion chamber 104. The ink movement flow channel valve 114 which opens and closes the ink movement flow channel 112 is provided in the ink movement flow channel 112.

Furthermore, an ink expulsion port 116 from which the ink inside the gas expulsion chamber 104 is expelled to the exterior of the print head 50 is provided in the end portion of the gas expulsion chamber 104 on the opposite side in the lengthwise direction from the end portion which is connected to the ink movement flow channel 112. As shown in FIG. 5, the ink expulsion port 116 is connected to one end portion of an ink expulsion flow channel 118, and the other end portion of the ink expulsion flow channel 118 is connected to a circulation pump 120. Moreover, an expulsion flow channel valve 122 which opens and closes the ink expulsion flow channel 118 is provided in the ink expulsion flow channel 118.

According to the composition described above, if the ink movement flow channel valve 114 provided in the ink movement flow channel 112 is open, and if the expulsion flow channel valve 122 provided in the ink expulsion flow channel 118 is opened and the circulation pump 120 is operated, then the ink inside the common liquid chamber 55 can be made to flow into the gas expulsion chamber 104 via the ink movement flow channel 112.

Furthermore, the circulation pump 120 functions as a device for adjusting the pressure of the ink inside the gas expulsion chamber 104. In other words, by operating the circulation pump 120 in a state where the ink movement flow channel valve 114 is closed, a pressure is generated in the gas expulsion chamber 104 in such a manner that the gas expulsion chamber 104 assumes a negative pressure with respect to the common liquid chamber 55. Moreover, the circulation pump 120 functions as a device which aids the dissolution of the bubbles into the ink inside the gas expulsion chamber 104 by creating a flow in the ink inside the gas expulsion chamber 104.

As shown in FIG. 5, a deaeration device 124 is connected to the ink expulsion flow channel 118 via the circulation pump 120. Moreover, one end of an ink circulation channel 126 is connected to the deaeration device 124 and the other end of the ink circulation channel 126 is connected to the ink supply tank 60.

In other words, the ink expelled from the gas expulsion chamber 104 is sent to the deaeration device 124 via the ink expulsion flow channel 118 and the circulation pump 120, and furthermore, the ink which has been deaerated by the deaeration device 124 is sent to the ink supply tank 60 via the ink circulation channel 126. Since the circulation flow channel including the ink expulsion flow channel 118, the circulation pump 120, the deaeration device 124 and the ink circulation channel 126, is provided, then it is possible to reuse the ink which has been expelled from the print head 50.

In the inkjet recording apparatus 10 according to the present invention, the concentration A of dissolved gas in the ink inside the gas expulsion chamber 104 is calculated on the basis of the pressure value ($P_{in}$) of the bubbles determined in the gas expulsion chamber 104, and if the concentration of dissolved gas (A) in the ink in the gas expulsion chamber 104 exceeds a prescribed value (a concentration threshold value $A_0$), then it is judged that the concentration of dissolved gas in the ink in the common liquid chamber 55 has exceeded a prescribed value. Here, the prescribed value of the concentration of dissolved gas means a value of 20% to 50% of the saturated concentration of dissolved gas, and if the concentration of dissolved gas approaches the prescribed value, then there are concerns about the decline in the dissolution capacity of the bubbles (gas) (for example, the speed of dissolution of the bubbles declines). The prescribed value of the concentration of dissolved gas is set appropriately in accordance with the environmental conditions, such as temperature change in the common liquid chamber 55 (the print head 50).

If the concentration of dissolved gas in the gas expulsion chamber 104 rises, then when the apparatus is not printing, the ink inside the gas expulsion chamber 104 and the common liquid chamber 55 is expelled to the exterior of the print head 50, and new ink is introduced into the print head 50 (the common liquid chamber 55) from the ink supply tank 60. Furthermore, the expelled ink is sent to the deaeration device 124 and is subjected to deaeration treatment, whereupon the deaerated ink is returned to the ink supply tank 60 via the ink circulation channel 126. Moreover, new ink is supplied to the gas expulsion chamber 104 from the common liquid chamber 55. The details of the calculation of the concentration of dissolved gas, the deaeration treatment and the circulation process described above will be explained later.

Description of Ink Supply System

Next, the general composition of the ink supply system of the inkjet recording apparatus 10 will be described. FIG. 7 is a conceptual diagram showing the composition of an ink supply system in the inkjet recording apparatus 10. In FIG. 7, items which are the same as or similar to those in FIG. 5 are labeled with the same reference numerals and description thereof is omitted here.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink tank 60 of the refillable type is filled with ink through a filling port (not shown)

and the ink tank 60 of the cartridge type is replaced with a new one. In the case of changing the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the print head 50 as shown in FIG. 7. The filter mesh size in the filter 62 is preferably equivalent to or less than the diameter of the nozzle and commonly about 20 μm.

Desirably, a composition is adopted in which a sub tank (not illustrated) is provided in the vicinity of the print head 50, or in an integrated fashion with the print head 50. The sub tank has a function of maintaining a meniscus by applying a prescribed negative pressure to the nozzles 51, and a function of improving damping effects to prevent internal pressure variations in the pressure chambers 52 and the common liquid chamber 55, and of improving refilling.

A mode which controls the internal pressure of the common liquid chamber 55 by means of a sub tank may be a mode in which the internal pressure in the pressure chambers 52 is controlled by means of the differential between the ink level in a sub tank open to the atmosphere and in the pressure chambers 52 inside the print head 50, a mode in which the internal pressure in the sub tank and the pressure chambers 52 is controlled by means of a pump connected to a sealed sub tank, and the like, and either of these modes may be adopted. Since gas is more likely to dissolve in the ink collected in the sub tank and the concentration of dissolved gas is increased when the mode is adopted which uses a sub tank open to the atmosphere, then it is desirable to use a sealed sub tank as in the present embodiment.

Description of Maintenance of Head

As shown in FIG. 7, a cap 64 forming a device for preventing the drying of the nozzles 51 or increase in the viscosity of the ink in the vicinity of the nozzles 51 is provided in the inkjet recording apparatus 10, and a blade 66 is provided as a device for cleaning (wiping) the nozzle forming surface on which the nozzles 51 are formed.

A maintenance unit including the cap 64 and the blade 66 can be relatively moved with respect to the print head 50 by a movement mechanism (not shown), and is moved from a predetermined holding position to a position below the print head 50 as required.

The cap 64 shown in FIG. 7 has a size which enables it to cover the whole of the nozzle forming surface of the print head 50. The cap 64 is displaced upwards and downwards in a relative fashion with respect to the print head 50 by an elevator mechanism (not shown). When the power of the inkjet recording apparatus 10 is switched off or when in a print standby state, the cap 64 is raised to a predetermined raised position thereby placing same in close contact with the print head 500 (the nozzle forming surface of the print head 50), in such a manner that the nozzle forming surface is covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In such a situation, it will become difficult to eject ink normally from the nozzle 51, even if the piezoelectric element 58 is operated.

Therefore, before a situation of this kind develops (namely, while the ink viscosity is within a range which allows the ink to be ejected by operation of the piezoelectric element 58), the piezoelectric element 58 is operated, and a preliminary ejection ("purge", "blank ejection" or "liquid ejection") is carried out toward the cap 64 (ink receptacle), in order to expel the degraded ink (namely, the ink in the vicinity of the nozzle which has increased viscosity).

This operation is carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chambers 52, the ink consumption is considerably large. Therefore, desirably, preliminary ejection is carried out while the increase in the viscosity of the ink is still minor. Although not shown in the drawings, a desirable mode is one in which the interior of the cap 64 is divided up in accordance with the respective print heads 50, in such a manner that suctioning can be carried out individually in the respective print heads 50.

The blade 66 functions as a wiping device for removing dirt from the nozzle forming surface of the print head 50 by moving while pressing against the nozzle forming surface. A hard rubber material, or the like, is suitable for use in the blade 66. In other words, the blade 66 has a prescribed strength (rigidity) and a prescribed elasticity, and the surface thereof has prescribed hydrophobic properties whereby the ink liquid droplets are repelled from the surface of blade 66. The blade 66 is constituted of a member which is capable of wiping and removing ink (ink that has solidified on the nozzle forming surface), paper dust, and other foreign matter, which has adhered to the nozzle forming surface.

Furthermore, although not shown in FIG. 7, the head maintenance mechanism (head maintenance device) of the inkjet recording apparatus 10 includes a blade elevator mechanism (notshown), which moves the blade 66 in the upward and downward directions and thus switches the blade 66 between a state of contact and non-contact with the nozzle forming surface, and a cleaning device which removes foreign matter adhering to the blade 66.

Description of Gas (Bubble) Determination

Figure 8A:
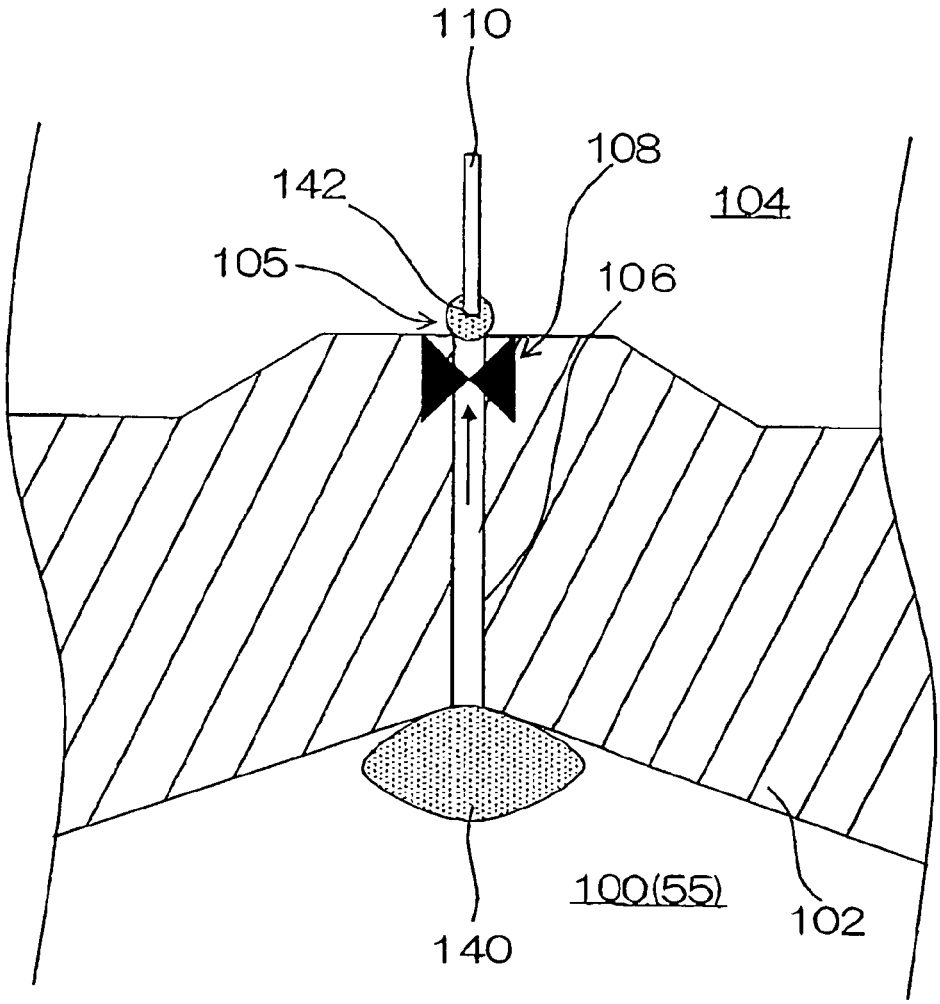
FIGS. 8A and 8B are diagrams illustrating measurement of the internal pressure of a bubble.

Next, the determination of the gas inside the common liquid chamber 55 is described in detail. FIG. 8A is a general schematic drawing for describing the determination of gas according to the present embodiment. In the gas processing (gas determination) described in the present embodiment, the gas 140 in the common liquid chamber 55 is accumulated in the gas accumulating section 100 provided to the upper surface of the common liquid chamber 55, the gas flow channel valve 108 provided in the gas flow channel 106 which connects the gas accumulating section 100 (common liquid chamber 55) with the gas expulsion chamber 104 (bubble nozzle 105), is closed after being left open for a prescribed period of time, and a part of the gas 140 in the gas accumulating section 100, is expelled from the bubble nozzle 105 and into the gas expulsion chamber 104. One bubble (small bubble) 142 having a prescribed size (diameter) is created at the bubble creation position in the vicinity of the bubble nozzle 105.

As shown in FIG. 8A, the determination section of the bubble pressure sensor 110 is introduced inside the bubble 142 created at the gas bubble creation position (the bubble pressure sensor 110 according to the present embodiment has the determination section that is positioned at the front end portion of the sensor 110), and the internal pressure value $P_{in}$ of the bubble 142 is thereby measured.

If there is a variation in the size of the bubble of which the internal pressure value $P_{in}$ is to be measured, then the measurement range of the bubble pressure sensor 110 needs to be set to a broad range, and if the measurement range is broadened, then the measurement accuracy declines. Therefore, in order to ensure measurement accuracy, then it is desirable that the size of the bubbles 142 which form the determination objects be uniform.

Figure 9:
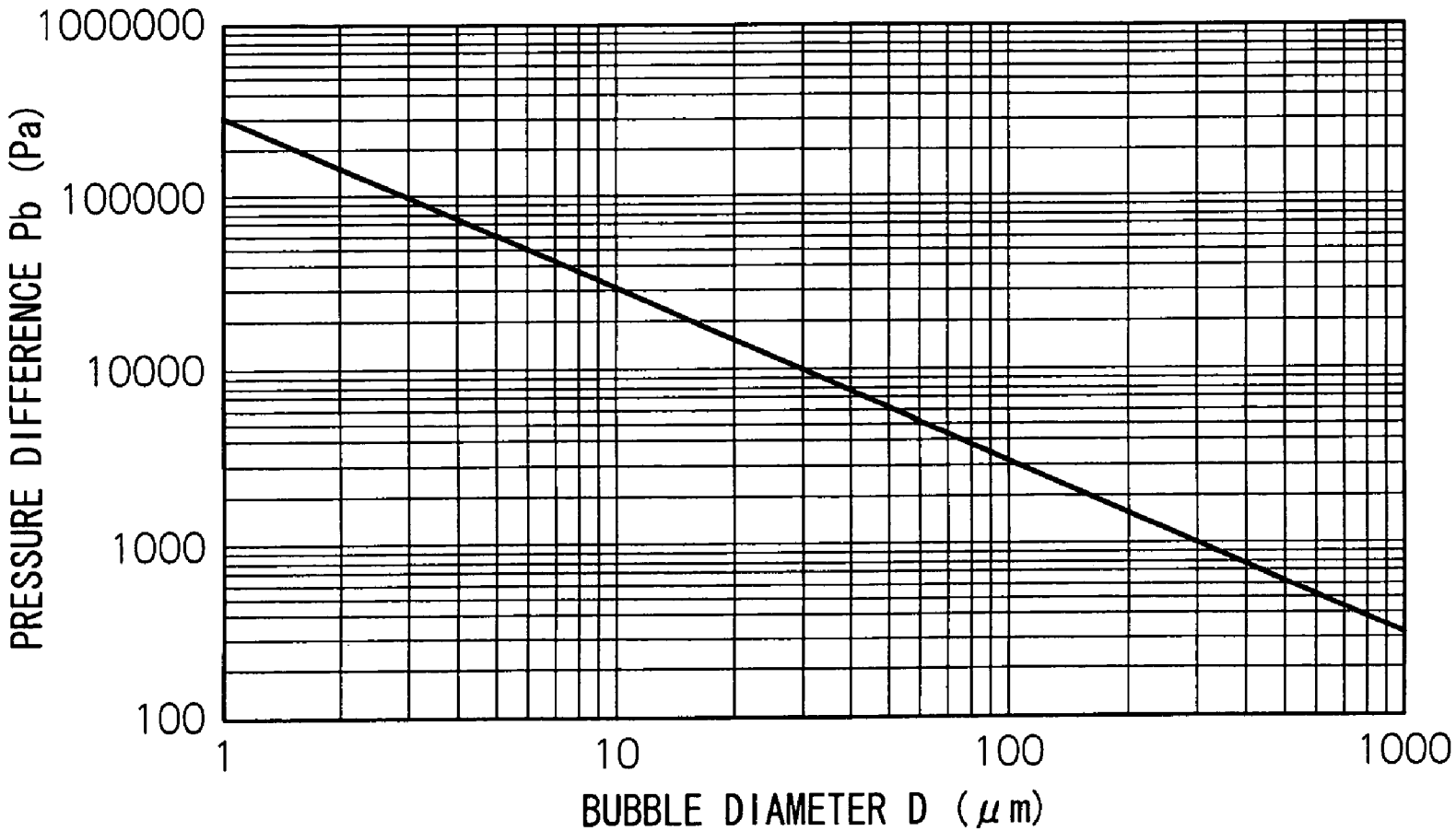
FIG. 9 is a diagram showing the relationship between a diameter of the bubble and a pressure difference between the inside and the outside of the bubble.

Moreover, there is the following relationship between the bubble size and the internal pressure of the bubble: the internal pressure of the bubble becomes larger as the size of the bubble becomes smaller (see FIG. 9). Therefore, by creating gas bubbles which are small in size, it is possible to improve the measurement sensitivity.

In order to determine the gas with high precision, it is necessary to identify the position at which the gas is present and to ascertain the amount (volume) of the gas (the volume of the gas which forms the determination object). However, in the case of the common liquid chamber 55 having a large size which is provided in a line head such as that shown in FIG. 5, it is difficult to identify the position at which the gas is present and to ascertain the size of the gas, and hence a highly accurate gas (bubble) determination cannot be achieved in a method which directly measures the pressure of the gas inside the common liquid chamber 55.

Since the print head 50 according to the present embodiment includes the gas accumulating section 100 provided in the common liquid chamber 55, then it is possible to identify the position at which the gas is present. Moreover, since a plurality of gas accumulating sections 100 are provided over the whole surface of the common liquid chamber 55, then it is possible to identify accurately the position at which the gas is present, whatever region of the common liquid chamber 55 the gas (bubble) is present in. Furthermore, since the gas (bubble) present inside the common liquid chamber 55 is moved to the gas expulsion chamber 104 in the form of small bubbles having a prescribed size, then it is possible to restrict the range in which the internal pressure of the bubble is measured, and hence the accuracy of the measurement of the internal pressure of the bubble is improved. In order to determine the internal pressure of a bubble which is of small size as described above, the gas (large bubble) of the common liquid chamber 55 is divided up (into small bubbles) and moved into the gas expulsion chamber 104. As described above the internal pressure determination of the bubble in the gas expulsion chamber 104 is carried out in place of the internal pressure determination of the bubble in the common liquid chamber 55, and the presence or absence of bubble in the common liquid chamber 55 is judged accordingly.

For the bubble pressure sensor 110 described above, it is suitable to use a fiber-optic pressure sensor, such as an FOP-M, miniature fiber-optic pressure meter, manufactured by FISO Technologies Inc. The diameter of the determination section of this miniature fiber-optic pressure meter, FOP-M, is 800 μm, and if a miniature fiber-optic pressure meter FOP-M is used for the bubble pressure sensor 110, then the bubble forming the determination object may have a diameter of approximately 800 μm. Moreover, since the fiber-optic pressure sensor with a determination section having a diameter of 550 μm, or of not more than 100 μm, is also commercially available, then it is more desirable to create smaller bubbles (more desirably, bubbles with a diameter of 100 μm or less) in accordance with the diameter of the determination section of the bubble pressure sensor 110.

Furthermore, in the inkjet recording apparatus 10 according to the present invention, if it is judged that the gas is present in the common liquid chamber 55, then the gas flow channel valve 108 is left open for a prescribed period of time and then closed for a prescribed period of time, and this opening and closing of the gas flow channel valve 108 is repeated in order to divide up the gas 140 in the common liquid chamber 55 and expel same into the gas expulsion chamber 104, whereby the gas (bubbles) can be made to dissolve successively into the ink inside the gas expulsion chamber 104. In the control for opening the valve for a prescribed period of time and then closing same for a prescribed period of time, it is possible to set the open time (the on time, in other words, the bubble creation time) to the same length of time as that of the closed time (the off time, in other words, the bubble dissolution time), or to set the off time to be longer than the on time (in such a manner that a relatively long dissolution time is ensured).

Figure 8B:
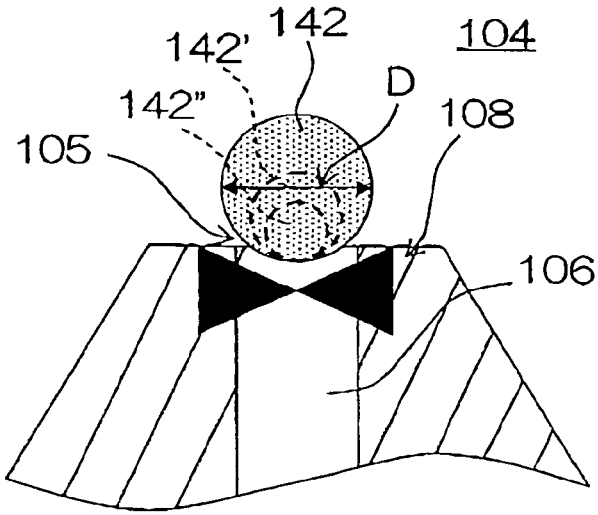

FIG. 8B is a diagram showing a state where the bubble 142 progressively dissolves into the liquid inside the gas expulsion chamber 104. The bubble 142 of a prescribed size is created while the gas flow channel valve 108 is open, and the bubble 142 dissolves into the liquid inside the gas expulsion chamber 104 while the gas flow channel valve 108 is closed. As time passes, the size of the bubble (the diameter D) gradually reduces as indicated by reference numerals 142' and 142". When the bubble created by one opening and closing cycle of the gas flow channel valve 108 has been completely dissolved into the liquid, a new bubble is created by opening and then closing the gas flow channel valve 108, and this bubble then dissolves while the gas flow channel valve 108 is closed.

In other words, the on time of one cycle of the gas flow channel valve 108 is determined in accordance with the size of the bubble 142 to be created, and the off time of one cycle of the gas flow channel valve 108 is determined in accordance with the time required for the bubble 142 to be dissolved. If the size of the bubble 142 is relatively small, then the speed of dissolution will be relatively high, and therefore in order to make the gas 140 inside the common liquid chamber 55 dissolve into the liquid inside the gas expulsion chamber 104, it is desirable that the bubbles 142 created at the bubble creation position be small in size.

In the gas processing described in the present embodiment, the gas in the common liquid chamber 55 is divided up and expelled into the gas expulsion chamber 104, and the divided bubbles are dissolved into the ink inside the gas expulsion chamber 104, and consequently there is no need to expel the ink inside the common liquid chamber 55 to the exterior and there is no wasteful consumption of ink involved in the gas processing.

FIG. 9 is a diagram showing the relationship between the diameter D (μm) of a bubble and the pressure difference $P_b$ (Pa) between the inside and the outside of the bubble. As shown in FIG. 9, there is an inversely proportional relationship between the diameter D of the bubble and the pressure difference $P_b$ between the inside and the outside of the bubble. In other words, if the surface tension of the ink is taken to be σ, then the diameter D of the bubble can be expressed as $D=4\times\sigma/P_b$. The diameter D of the bubble 142 can be calculated from the pressure differential $P_b$ between the inside and the outside of the bubble, on the basis of the above-described relationship.

The relationship between the diameter D (μm) of a bubble and the pressure differential $P_b$ (Pa) between the inside and the outside of the bubble shown in FIG. 9 is stored in a prescribed storage section (in the present embodiment, it is stored in the table storage unit 204 in FIG. 12). This relationship may be stored as a data table or it may also be stored in the form of an equation.

Next, the calculation of the concentration of dissolved gas will be described. If the pressure differential $P_b$ between the inside and the outside of the bubble is stored for a prescribed time period (or continuously), then it is possible to determine the history of change of the diameter D of the bubble over the passage of time (the time profile of the extinction of the bubble). There is the following relationship between the concentration of dissolved gas in the liquid into which the bubbles are dissolved (in the present example, the ink inside the gas expulsion chamber 104) and the change in the diameter D of the bubble: the amount (the gas dissolution speed) by which the higher the concentration of dissolved gas, the diameter D of the bubble decreases per unit time becomes smaller. Therefore, the concentration of dissolved gas in the ink inside the gas expulsion chamber 104 is obtained on the basis of the history of change in the diameter D of the bubble.

Figure 10:
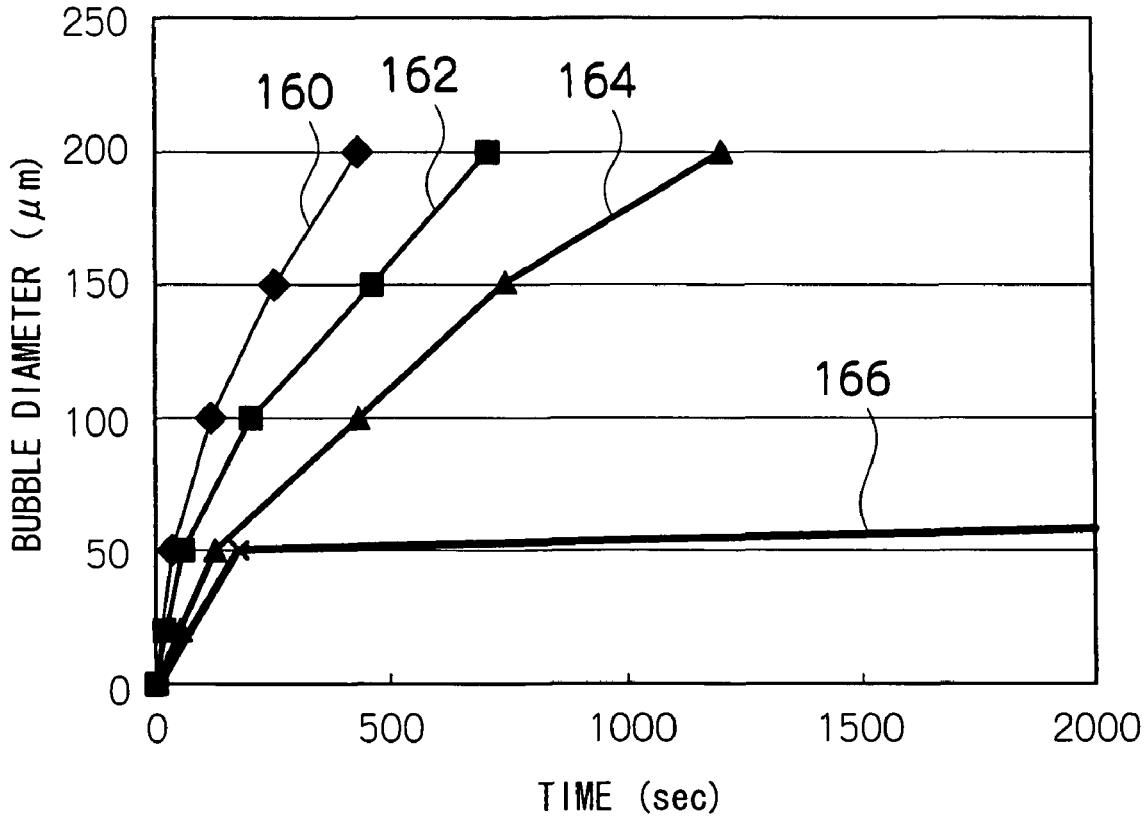
FIG. 10 is a diagram showing the relationship between the passage of time and the diameter of the bubble.

FIG. 10 is a diagram showing examples of the bubble diameter change history. The curve 160 in FIG. 10 indicates the history of change of the diameter of a bubble where the concentration of dissolved gas is 3 (mg/l), and the curves 162 and 164 indicate the histories of change of the diameter of a bubble where the concentrations of dissolved gas are 5 (mg/l) and 7 (mg/l), respectively. Furthermore, the broken line 166 indicates a case where the concentration of dissolved gas is 9 (mg/l). If the history of change of the diameter of the bubble has characteristics as indicated by the broken line 166, then there is no change in the diameter of the bubble (the bubble does not dissolve), and therefore the concentration of dissolved gas has reached saturation in the case of the broken line 166.

The bubble diameter change histories for respective concentrations of dissolved gas in the ink in the gas expulsion chamber 104 are previously obtained (or previously calculated by simulation, or the like), and are stored as reference data in the form of a data table (in the present embodiment, they are stored in the table storage unit 204 in FIG. 12). This reference data is compared with a bubble diameter change history obtained from the actual measurement results, more specifically, the history in the reference data which is closest to the bubble diameter change history that is actually obtained according to the measurement results, is identified, and the concentration of dissolved gas in the ink inside the gas expulsion chamber 104 is calculated on this identification results.

A temperature sensor (temperature measurement device) may be provided in the gas expulsion chamber 104, and the value of the surface tension σ of the ink may be corrected in consideration of the measured temperature in the gas expulsion chamber 104. If the surface tension σ of the ink is corrected on the basis of the ink temperature, then the effects of change in the ink temperature are eliminated, and improved accuracy in measuring the internal pressure of the bubble 142 (in other words, the diameter D of the bubble 142) can be expected.

Figure 11A:
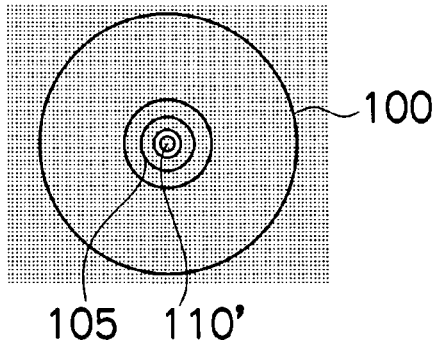
FIGS. 11A to 11D are diagrams showing other aspects of the bubble pressure sensor shown in FIGS. 8A and 8B.
Figure 11B:
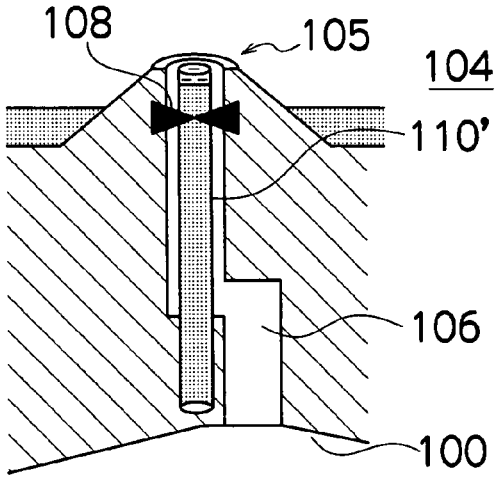
Figure 11C:
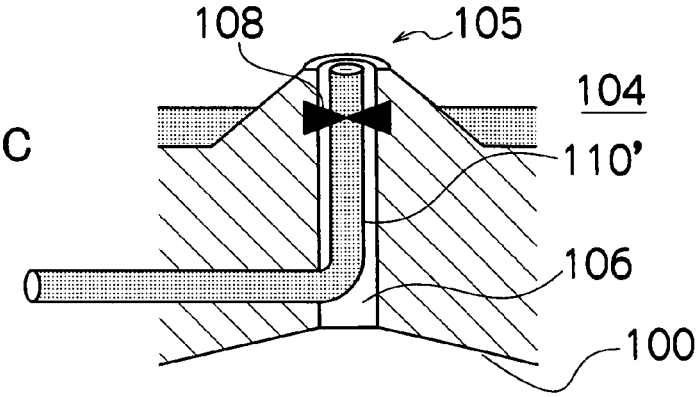

FIGS. 11A to 11C are diagrams showing further examples of the composition of the bubble pressure sensor (examples where a tubular type of fiber-optic pressure sensor is used). FIG. 11A is an upper surface diagram of the bubble nozzle 105 as viewed from the gas expulsion chamber 104 side, and FIGS. 11B and 11C are cross-sectional diagrams of FIG. 11A. Furthermore, FIG. 11B and FIG. 11C show different arrangements of the bubble pressure sensor 110' and the gas flow channel 106.

The bubble pressure sensor 110' shown in FIGS. 11A to 11C is introduced inside the bubble nozzle 105, and the pressure determination section situated at the front tip thereof is held in such a manner that it projects into the gas expulsion chamber 104 beyond the opening section of the bubble nozzle 105. The outer diameter of the bubble pressure sensor 110' is smaller than the inner diameter of the gas flow channel 106 (and desirably, it is 50% or less of the inner diameter of the gas flow channel 106), and it is disposed in such a manner that it does not seal off the gas flow channel 106.

The bubble expelled from the gas accumulating section 100 is moved to the bubble nozzle 105 by passing through the space between the inner wall of the gas flow channel 106 and the outer surface of the bubble pressure sensor 110'.

As shown in FIG. 11B, a composition may be adopted in which the bubble pressure sensor 110' is disposed (linearly) in a straight shape in the vertical direction with respect to the bubble nozzle 105, and the gas flow channel 106 is bent (namely, two bents each of which is constituted of a bent with a substantially right angle (about 90 degrees)). As shown in FIG. 11C, a composition may also adopted in which the bubble pressure sensor 110' is bent (namely, a bent with a substantially right angle (about 90 degrees)), while the gas flow channel 106 is disposed in a straight linear fashion, in a vertical direction with respect to the bubble nozzle 105.

Figure 11D:
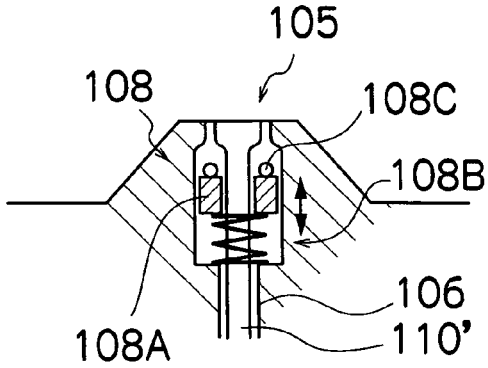

FIG. 11D is a diagram showing one example of the gas flow channel valve 108 used in a mode where the bubble pressure sensor 110' is provided inside the gas flow channel 106. The gas flow channel valve 108 shown in FIG. 11D includes: a valve member 108A having a hollow ring-shaped structure; a compression coil (spring) 108B which impels the valve member 108A toward the bubble nozzle 105 side; and a seal member 108C which closes off the gas flow channel 106 by deforming elastically when the valve member 108A is pressed against an abutting surface on the bubble nozzle 105 due to the impelling force of the compression coil 108B. The bubble pressure sensor 110' is introduced into the hollow central portion.

The gas flow channel valve 108 shown in FIG. 11D is able to open and close the gas flow channel 106 by means of the valve member 108A being moved in the upward and downward direction in FIG. 11D by means of a magnetic force or a mechanical mechanism.

Description of Control System

Next, the control system of the inkjet recording apparatus 10 according to the present example will be described. FIG. 12 is a principal block diagram showing the system composition of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, and the like. Furthermore, although not shown in the drawings, sensors, such as a temperature sensor which measures the temperature inside the print head 50, and a position sensor which determines the position of a movable body in accordance with the movement mechanism, are provided.

The communication interface 70 is an interface unit for receiving image data sent from a host computer 86. A serial interface such as USB (Universal Serial Bus), IEEE1394, Ethernet®, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The motor driver 76 and the motor 88 in FIG. 12 include a plurality of motor drivers and motors, respectively. In other words, the system controller 72 controls the plurality of motors by means of the plurality of motor drivers.

To give examples of the plurality of motors, there is a motor which causes the rollers 31 and 32 in FIG. 1 to rotate, and a motor of the elevator mechanism which raises and lowers the blade shown in FIG. 7, and the like.

Moreover, the heater driver 78 drives the heater 89 of the post-drying unit 42, or the like, in accordance with commands from the system controller 72. The heater 89 shown in FIG. 12 includes heaters such as a heater used in a post-drying unit 42, as shown in FIG. 1, a temperature adjustment heater for the respective print heads 50, and the like.

The print controller 80 has a signal processing function for performing various tasks, compensations, and other types of processing for generating print control signals from the image data stored in the image memory 74 in accordance with the control of the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 12 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators of the print head 50 (each of the print heads 50) of the respective colors on the basis of print data supplied by the print controller 80. The head driver 84 can be provided with a feedback control system for maintaining constant drive conditions for the print heads.

The program storage unit 90 stores control programs for the inkjet recording apparatus 10, and the system controller 72 reads out the various control programs stored in the program storage unit 90, as and when appropriate, and executes the control programs.

The print determination unit 24 is a block including a line sensor, which reads in the image printed onto the recording paper 16, performs prescribed signal processing, and the like, and determines the print situation (presence/absence of ejection, variation in droplet ejection, and the like), these determination results being supplied to the print controller.

Furthermore, according to requirements, the print controller 80 makes various corrections with respect to the print head 50 on the basis of information obtained from the print determination unit 24.

The pump driver 200 is a control block which controls the circulation pump 120 shown in FIG. 5 and the pump 67 shown in FIG. 7. The pump is switched on and off, and the generated pressure and the drive direction are controlled, on the basis of control signals sent by the system controller 72.

The valve unit 202 is a control block which controls the control valves, such as the gas flow channel valve 108 in FIG. 4, the ink movement flow channel valve 114, the expulsion flow channel valve 122, and the like. The respective control valves are opened and closed selectively, and the opening and closing times (time lengths) of the respective control valves are controlled, on the basis of the control signals sent by the system controller 72.

In other words, the system controller 72 functions as a control block which performs integrated control of the pump driver 200, the valve control unit 202, and the like, and the system controller 72 can control the on and off operation of the expulsion flow channel valve 122 in synchronism with the opening and closing control of the ink movement flow channel valve 114 shown in FIG. 5.

Furthermore, the system controller 72 sends a control signal to the deaeration device 124 and controls the deaeration device 124. For example, the deaeration device 124 is driven in synchronism with the opening of the expulsion flow channel valve 122 and the on operation of the circulation pump 120, and the deaeration processing is continued until the concentration of dissolved gas in the supplied liquid becomes equal to or less than a prescribed value. The control of the amount of deaeration by the deaeration device 124 may be based on the control of the deaeration time, and it is also possible to provide a dissolved oxygen meter and to control the amount of deaeration while monitoring the measurement value of the dissolved oxygen meter.

The measurement signals (determination values) are sent from the bubble pressure sensor 110 and the liquid pressure sensor 111 to the system controller 72, and the system controller 72 stores the internal measured pressure value $P_{in}$ of the bubble and the measured pressure value $P_{out}$ of the liquid as one set, in the bubble memory 206, in association with the identification number of the gas accumulating section 100 and the bubble nozzle 105 (shown in FIG. 5), and the number of samples (see FIG. 22).

Furthermore, the system controller 72 determines the pressure differential $P_b$ between the inside and the outside of the bubble on the basis of the measured internal pressure value $P_{in}$ of the bubble and the measured pressure value $P_{out}$ of the liquid, and converts this pressure differential $P_b$ into a diameter D of the bubble and stores this value in the bubble memory 206 in association with the identification number of the bubble nozzle 105 and the number of samples.

Furthermore, a table storage unit 204 is provided which stores references of the bubble diameter change histories in the form of a data table (see FIG. 10). The reference data of change history of the bubble diameter D stored in this table storage unit 204 is read out successively, and the concentration of dissolved gas in the ink inside the gas expulsion chamber 104 is determined by comparing this reference data with the change history of the bubble diameter D determined from the pressure difference $P_b$ as calculated on the basis of the internal pressure value $P_{in}$ measured by the bubble pressure sensor 110 and the measured pressure value $P_{out}$ of the ink.

Although not shown in FIG. 12, a counter block (a timer block) is appended to the system controller 72 (or provided inside the system controller 72). This timer block is used for measuring the opening and closing times (time lengths) of the valves, such as the gas flow channel valve 108 shown in FIG. 4, and the operating time of the circulation pump 120, or the like. Moreover, a clock generating unit which generates a prescribed sampling clock is provided, and this unit generates a sampling clock for determination of the internal pressure of the bubble, and the like.

Furthermore, it is also possible to adopt a mode in which the memories shown in FIG. 12 are shared appropriately. It is also possible to adopt a mode which uses a memory incorporated into the device, such as the system controller, as these memories.

Description of Gas Processing Control

The control of bubble determination described above, the calculation of the concentration of dissolved gas and the control of gas dissolution are described in detail below with reference to the control flow diagrams. In the present embodiment, the term "gas processing control" is used as a general term for the control of gas determination, the control of calculating the concentration of dissolved gas, and the control of gas dissolution.

Figure 13:
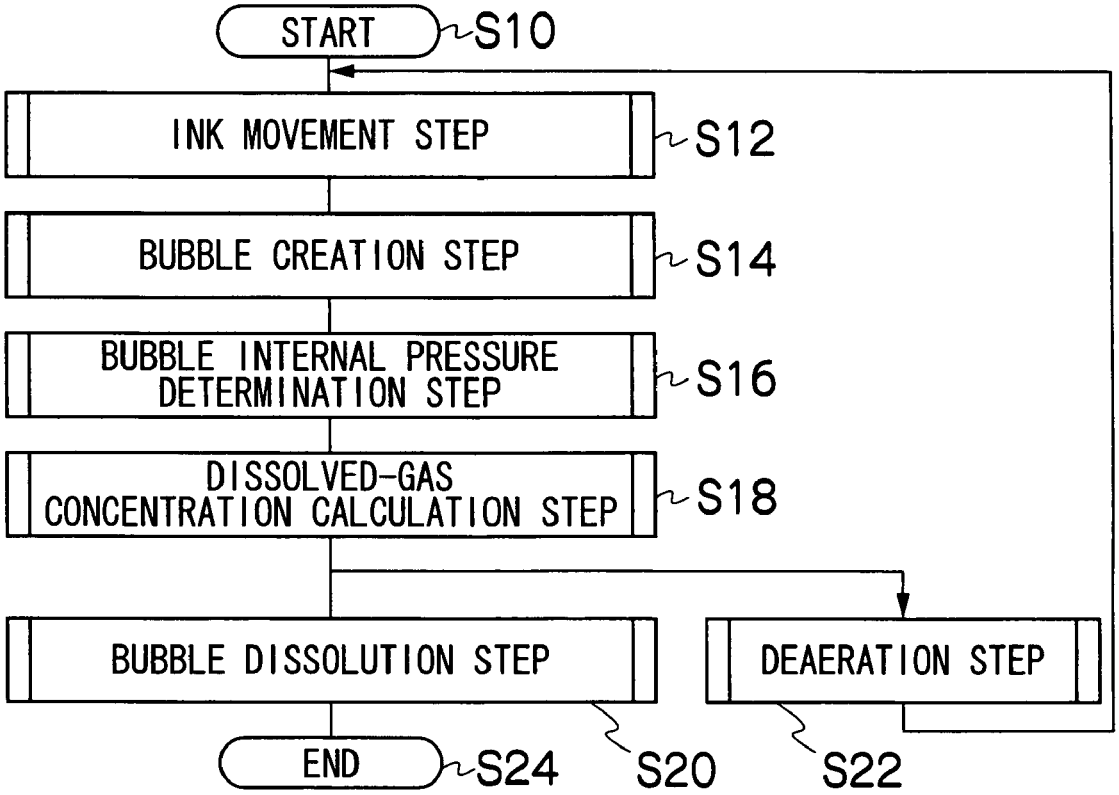
FIG. 13 is a flowchart showing a sequence of gas processing (bubble processing) control according to an embodiment of the present invention.

FIG. 13 is a diagram showing the respective steps which constitute the gas processing control according to the present embodiment. As shown in FIG. 13, the present gas processing control includes, as principal steps: an ink movement step (step S12 in FIG. 13) of moving the ink inside the common liquid chamber 55 (see FIG. 4) to the gas expulsion chamber 104 (see FIG. 4); a bubble creation step (step S14 in FIG. 13) of creating the bubble 142 (see FIG. 8A) which is a determination object, at the bubble creation position corresponding to each bubble nozzle 105 (see FIG. 4); a bubble internal pressure measurement step (step S16 in FIG. 13) of using a bubble pressure sensor 110 (see FIG. 4) to measure the internal pressure of the bubble 142 and judging whether a bubble (gas) is present in any of the bubble nozzles 105 (whether bubble is present in any of the gas accumulating sections 100); a dissolved-gas concentration calculation step (step S18) of calculating the concentration of dissolved gas in the ink inside the gas expulsion chamber 104 on the basis of the measurement result of step S116; a gas (bubble) dissolution step (step S20 in FIG. 13) of controlling the gas flow channel valve 108 (FIG. 4) provided in the gas flow channel 106 (FIG. 4) and dividing up the gas 140 (see FIG. 8A) in the gas accumulating section 100 (see FIG. 4) located at a position where bubble is judged to be present in the common liquid chamber 55, and thereby causing the gas (bubble) to be dissolved in the ink inside the gas expulsion chamber 104; and a deaeration processing step (step S22 in FIG. 13) of expelling the ink inside the common liquid chamber 55 and the ink in the gas expulsion chamber 104 to the exterior of the print head 50 if the concentration of dissolved gas in the ink inside the gas expulsion chamber 104 exceeds a prescribed value, and sending this ink to the deaeration device 124 (see FIG. 5) and carrying out deaeration processing in the deaeration device 124.

Ink Movement Step

Figure 14:
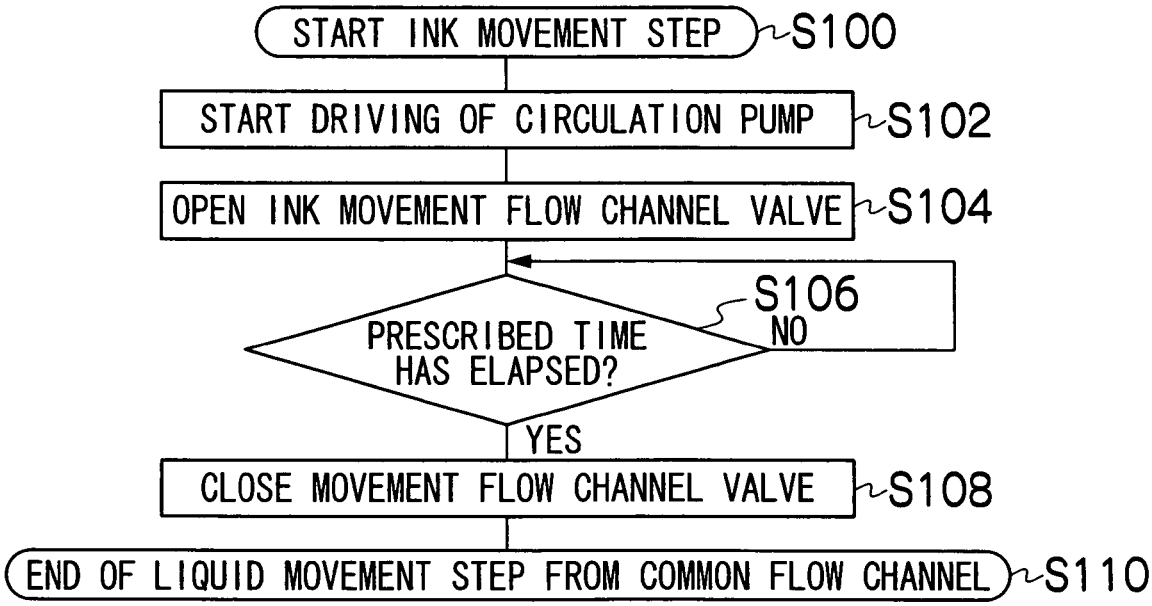
FIG. 14 is a flowchart of the ink movement step shown in FIG. 13.

FIG. 14 is a diagram showing the details of the ink movement step (step S12) in FIG. 13. As shown in FIG. 14, when the ink movement step is started (step S1100), the circulation pump 120 (see FIG. 5) is operated (step S102 in FIG. 14), and furthermore, the ink movement flow channel valve 114 (see FIG. 5) in the ink movement flow channel 112 is opened (step S104 in FIG. 14), and the ink inside the common liquid chamber 55 is moved to the gas expulsion chamber 104. Moreover, simultaneously with this, measurement of the opening time of the ink movement flow channel valve 114 is started. Ink is also introduced into the gas expulsion chamber 104 when initially filling ink into the print head 50 (namely, into the common liquid chamber 55).

The amount of ink moved to the gas expulsion chamber 104 is controlled by means of the opening time of the ink movement flow channel valve 114 (the operating time of the circulation pump 120). In other words, at step S106, it is judged whether or not a prescribed time period has elapsed, this prescribed time period being the time from the opening of the ink movement flow channel valve 114 (or from the start of operation of the circulation pump 120) until a prescribed amount of ink has moved to the gas expulsion chamber 104. If this prescribed time period has not yet elapsed (NO verdict), then the movement of ink to the gas expulsion chamber 104 is continued, whereas if the prescribed time period has elapsed (YES verdict), then the ink movement flow channel valve 114 is closed (step S108), and the ink movement step is terminated (step S110).

The ink movement time described above is measured by the counter block (time block) (not illustrated), and is stored in a prescribed memory.

The amount of ink moved from the common liquid chamber 55 to the gas expulsion chamber 104 in the ink movement step is equal to or greater than an amount whereby the whole of the ink inside the gas expulsion chamber 104 is replaced with ink from the common liquid chamber 55.

In the present embodiment, a mode is described in which the amount of ink moved to the gas expulsion chamber 104 is controlled on the basis of the opening time of the ink movement flow channel valve 114, but it is also possible to provide a determination device, such as a flow sensor (level sensor) inside the gas expulsion chamber 104, in such a manner that the amount of ink moved to the gas expulsion chamber 104 is controlled on the basis of the determination result of this determination device.

Bubble Creating Step

Figure 15:
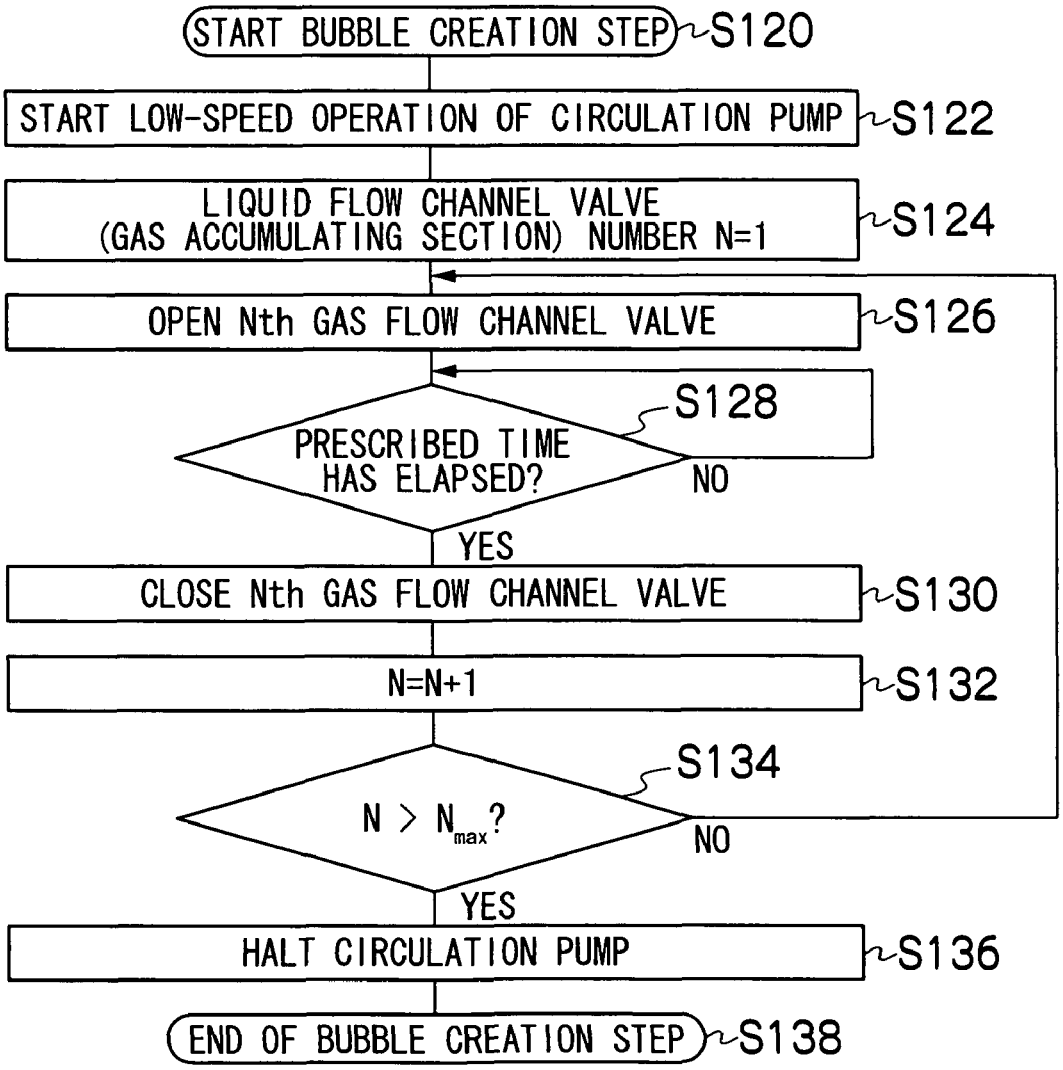
FIG. 15 is a flowchart of the bubble creation step shown in FIG. 13.

FIG. 15 is a diagram showing the details of the bubble creation step (step S14) shown in FIG. 13. As shown in FIG. 15, when the bubble creation process is started (step S120), the circulation pump 120 is switched to a low-speed operation and a flow is generated in the ink in the gas expulsion chamber 104, in addition to which the internal pressure in the gas expulsion chamber 104 is controlled in such a manner that the internal pressure of the gas expulsion chamber 104 assumes a negative pressure with respect to the common liquid chamber 55 (step S122), $N_{max}$ gas flow channel valves 108 corresponding to $N_{max}$ bubble nozzles 105 are successively opened for a prescribed period of time (the time length of the opening operation is the same for each of bubble nozzles), and one bubble 142 having a prescribed diameter, which is a determination object, is created at each of the bubble creation positions corresponding to the bubble nozzles 105 (hereinafter, the bubble creation position may be referred to as the bubble nozzle 105).

In other words, the number "1" is substituted for N of the gas flow channel valve number (gas accumulating section number) (step S124), the Nth (=1st) gas flow channel valve 108 is opened (step S126), and the measurement of the elapsed time from the opening of the opened gas flow channel valve 108 is started. Thereupon, it is judged whether or not the prescribed time period (i.e, the time until the bubble 142 forming the determination object assumes a prescribed diameter (for example, a diameter equal to or greater than 0.8 mm and equal to or less than 1 mm)) has elapsed (step S128), and if the prescribed time period has not elapsed at step S128 (NO verdict), then the opening of the Nth gas flow channel valve 108 is continued and if the prescribed time period has elapsed (YES verdict), then the Nth gas flow channel valve 108 is closed (step S130), N+1 is substituted for N (i.e., N=N+1) (step S132), and the procedure then advances to step S134.

At step S134, it is judged whether or not a bubble 142 forming a determination object has been created at each of the bubble nozzles 105, (in other words, whether or not N+1 exceeds the total number ($N_{max}$) of gas flow channel valves 108), and if there is a bubble nozzle 105 at which a bubble 142 forming a determination object has not yet been created (NO verdict), then the procedure advances to step S126 and a bubble 142 forming a determination object is created at the (N+1)th bubble nozzle 105.

On the other hand, if a bubble 142 forming a determination object has been created at each of the bubble nozzles 105 from 1 to $N_{max}$ (YES verdict), then the circulation pump 120 is halted (step S136) and the bubble creation step is terminated (step S138).

Bubble Internal Pressure Measurement Step

Next, the step of measuring the internal pressure of the bubble (step S16 in FIG. 13) will be described with reference to FIGS. 16 and 17. In the bubble internal pressure measurement step according to the present embodiment, the internal pressure is measured a plurality of times (corresponding to the sampling number $M_{max}$) at prescribed time intervals for the bubble created at each of the bubble nozzles 105, and the presence or absence of the bubble is judged on the basis of the measurement results, in addition to which the history of change in the diameter of the bubble used in the concentration of dissolved gas calculation step in FIG. 13 (step S18) is also determined.

When the bubble internal pressure measurement step is started (step S200), 1 is substituted for the sampling number M (i.e., M=1) (step S202), and the timer count is started (step S204), whereupon the procedure advances to step S206. This timer counts the time interval between the sampling timings.

Figure 16:
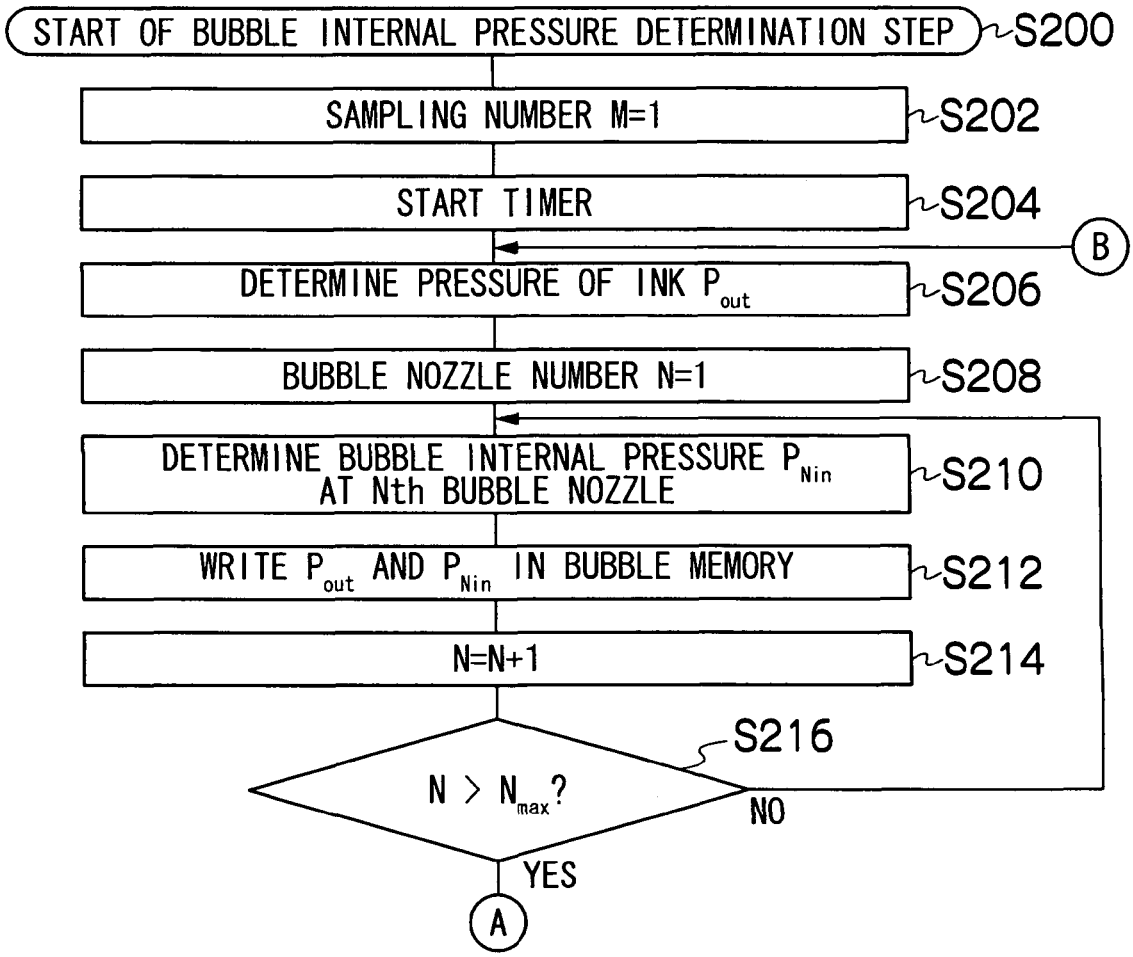
FIGS. 16 and 17 are flowcharts of the bubble internal pressure measurement step shown in FIG. 13.
Figure 17:
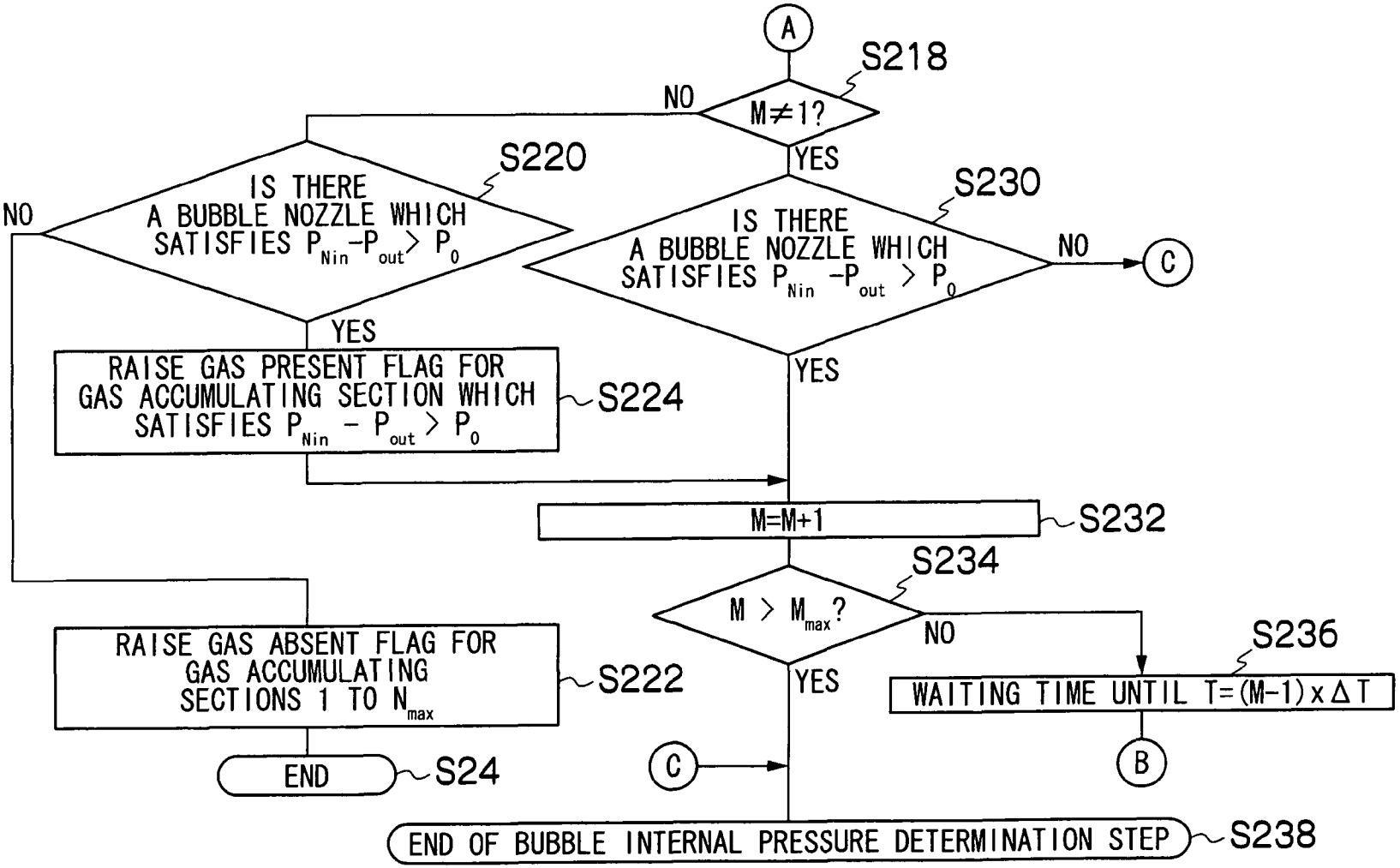

At step S206, the pressure value $P_{out}$ of the ink inside the gas expulsion chamber 104 is measured by the liquid pressure sensor 111 (see FIG. 5), and the procedure advances to step S208 in FIG. 16.

At step S208, 1 is substituted for the bubble nozzle number N (i.e., N=1), and the internal pressure value $P_{Nin}$ of the bubble 142 formed in accordance with the Nth (=1st) bubble nozzle 105 is measured by the bubble pressure sensor 110 provided corresponding to the Nth bubble nozzle 105 (step S210). The measured internal pressure value $P_{Nin}$ of the bubble 142 at the Nth bubble nozzle 105 is stored in association with the bubble nozzle number, in the bubble memory 206 shown in FIG. 12 (step S212 in FIG. 16).

When the measured internal pressure value $P_{Nin}$ of the bubble 142 corresponding to the Nth bubble nozzle 105 has been stored, then N+1 is substituted for the bubble nozzle number N (i.e., N=N+1) (step S214), and it is judged whether or not the measured internal pressure value $P_{Nin}$ of the bubble has been acquired for all of the bubble nozzles 105 from 1 to $N_{max}$ (it is judged whether or not the inequality equation of $N>N_{max}$ is satisfied) (step S216).

At step S216, if there is a bubble nozzle at which the measured internal pressure value $P_{Nin}$ has not yet been obtained (NO verdict), then the procedure advances to step S210, and the internal pressure of the bubble corresponding to the next bubble nozzle 105 is measured and the measured internal pressure value $P_{Nin}$ is acquired and stored accordingly. If, on the other hand, the measured internal pressure value $P_{Nin}$ of the bubble has been acquired for all of the bubble nozzles 105, from 1 to $N_{max}$ (YES verdict), then the procedure advances to step S218 shown in FIG. 17.

If there is no bubble present in the gas accumulating section 100 (see FIG. 4), then there may be a case where no bubble is created at the bubble nozzle 105, and consequently a value of 0 (zero) is stored as the measured internal pressure value $P_{Nin}$ for such a bubble nozzle 105 where no bubble 142 is present.

At step S218, it is judged whether or not this is the first sampling, and if this sampling is judged to be the first sampling (i.e., if the relationship of $M\neq1$ is not satisfied) (NO verdict), then the procedure advances to step S220, and it is judged whether or not there is a bubble, (in other words, whether or not there is a bubble that satisfies the relationship of $P_{Nin}-P_{out}>P_0$) whereby the pressure differential $P_b$ between the measured internal pressure value $P_{Nin}$ of the bubble and the measured pressure value $P_{out}$ of the ink inside the gas expulsion chamber 104 is greater than a reference value (threshold value) $P_0$.

Here, by subtracting the measured pressure value $P_{out}$ of the ink inside the gas expulsion chamber 104 from the measured internal pressure value $P_{Nin}$ of the bubble, it is possible to eliminate the effects caused by the pressure value $P_{out}$ of the ink, which are involved in the measured internal pressure value $P_{Nin}$ of the bubble, and therefore it is possible to obtain a satisfactory value for the pressure difference $P_b$ between the inside and the outside of the bubble. Furthermore, it is possible to judge that no bubble is present when the conditions of $P_{Nin}-P_{out}=0$ are met, provided that the internal pressure value $P_{Nin}$ of the bubble and the pressure value $P_{out}$ of the ink are measured in an ideal environment. In the present embodiment, a reference value $P_0$ is determined in order to take account of the effects of noise which may be superimposed on the measurement signal obtained from the bubble pressure sensor 110 or the liquid pressure sensor 111, or error occurring when the measurement signal is subjected to prescribed signal processing, or other factors.

At step S220, if there is no bubble nozzle 105 at which the relationship of $P_{Nin}-P_{out}>P_0$ is satisfied, in other words, if no gas is present in the common liquid chamber 55 (NO verdict), then a gas absent flag (see FIG. 22) is established for all of the gas accumulating sections 100, from 1 to $N_{max}$ (step S222), and the procedure advances to step S24 in FIG. 13, where the bubble processing control is terminated.

On the other hand, if at step S220 there is a bubble nozzle 105 at which the relationship of $P_{Nin}-P_{out}>P_0$ is satisfied (YES verdict), then a gas present flag (see FIG. 22) is established for the corresponding gas accumulating section 100 (step S224). Thereupon, the procedure advances to step S232 and the next sampling operation is carried out.

At step S232, M+1 is substituted for the sampling number M, and it is judged whether or not the sample number M (=M+1) is equal to or less than the maximum sampling number $M_{max}$ (step S232). If the next sampling number is equal to or less than the maximum sampling number (NO verdict), then taking the sampling period to be $\Delta T$, the procedure waits at standby until the time point of $T=(M-1)\times\Delta T$ (until the next sample timing) (step S236), and the procedure then advances to step S206.

During the waiting time until the arrival of the next sample timing, the bubble at the bubble nozzle 105 is dissolved into the ink inside the gas expulsion chamber 104 and the diameter of the bubble becomes smaller. In other words, the sample timing $\Delta T$ is determined in accordance with the diameter of the bubble 142 created at the bubble nozzle 105 and the speed of dissolution of the bubble 142 (the ratio by which the diameter of the bubble changes with the passage of time). On the other hand, at step S234, if the maximum number of samplings have been completed (YES verdict), then the bubble internal pressure measurement step is terminated (step S238).

Dissolved-gas Concentration Calculation Step

Figure 18:
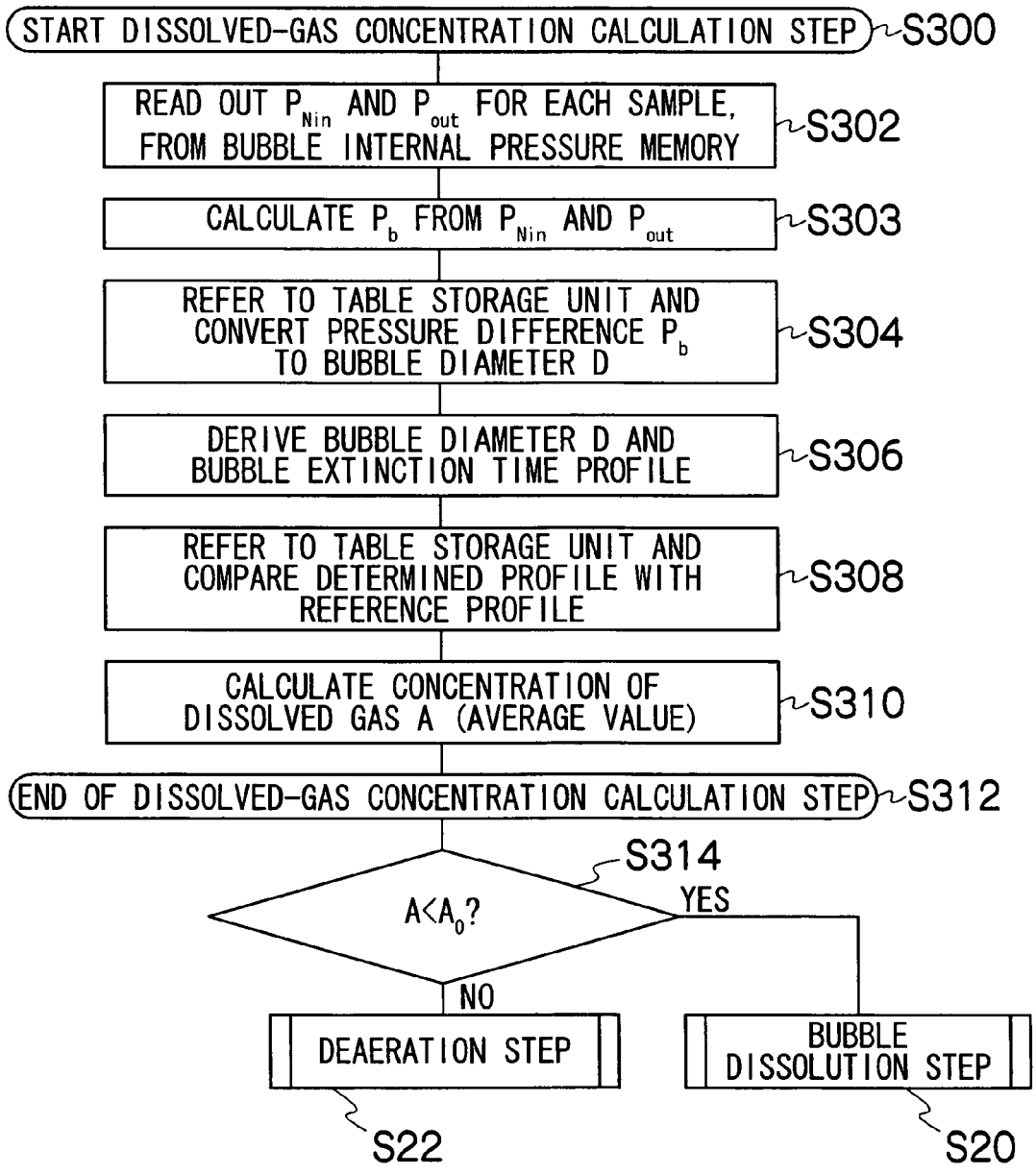
FIG. 18 is a flowchart of the dissolved gas concentration calculation step shown in FIG. 13.

Next, the concentration of dissolved gas calculation step shown in step S18 in FIG. 13 will be described with reference to FIG. 18. As shown in FIG. 18, when the dissolved gas concentration calculation step is started (step S300), the data of the measured internal pressure values $P_{Nin}$ of the bubbles 142 and the measured pressure value $P_{out}$ of the ink in the gas expulsion chambers 104 at each sample timing and at each bubble nozzle 105, is read out from the bubble memory 206 (see FIG. 12) (step S302), whereupon the pressure difference $P_b$ between the inside and the outside of the bubble is determined accordingly (step S303).

By referring to the data table (which is stored in the table storage unit 204; see FIG. 9) which indicates the correlation between the pressure difference $P_b$ and the diameter D of the bubble, the pressure difference $P_b$ is converted into the diameter D of the bubble (step S304), and the procedure then advances to step S306.

At step S306, the history of change in the diameter of the bubble with respect to the passage of time (the bubble extinction time profile) is determined, the sample (reference) data table (see FIG. 10) of the bubble extinction profiles stored in the table storage unit 204 is referenced, and by comparing the reference bubble extinction profiles with the bubble extinction profile calculated on the basis of the pressure difference $P_b$, the concentration of dissolved gas A in the ink inside the gas expulsion chamber 104 is estimated, whereupon the concentration of dissolved gas calculation step ends (step S312).

In other words, the concentration of dissolved gas is inferred by identifying the reference for the bubble extinction profile which is closest to the bubble extinction profile derived from the pressure difference $P_b$ which is determined through the bubble internal pressure measurement step.

If the bubble extinction profile is calculated for each of a plurality of bubble nozzles 105 (if there are a plurality of bubble extinction profiles), then the average value of the plurality of bubble extinction profiles is taken to be used for the estimation of the concentration of dissolved gas A in the ink inside the gas expulsion chamber 104.

After the concentration of dissolved gas A in the gas expulsion chamber 104 has been calculated by means of the concentration of dissolved gas calculation step, the value of the concentration of dissolved gas A is compared with a reference concentration of dissolved gas value (a threshold value for the concentration of dissolved gas) $A_0$ (step S314), and if the calculated concentration of dissolved gas A is smaller than the reference concentration of dissolved gas $A_0$ (YES verdict), the procedure advances to the gas dissolution step (step S20 in FIG. 13), and if the calculated concentration of dissolved gas A is equal to or greater than the reference concentration of dissolved gas $A_0$ (NO verdict), then the procedure advances to a deaeration step (step S22 in FIG. 13).

The preferable value of reference concentration of dissolved gas $A_0$ is the smallest possible value such that a prescribed gas dissolution capability is ensured, and this value may be, for example, 20% to 50% of the saturation value of the concentration of dissolved gas.

Gas (Bubble) Dissolution Step

Figure 19:
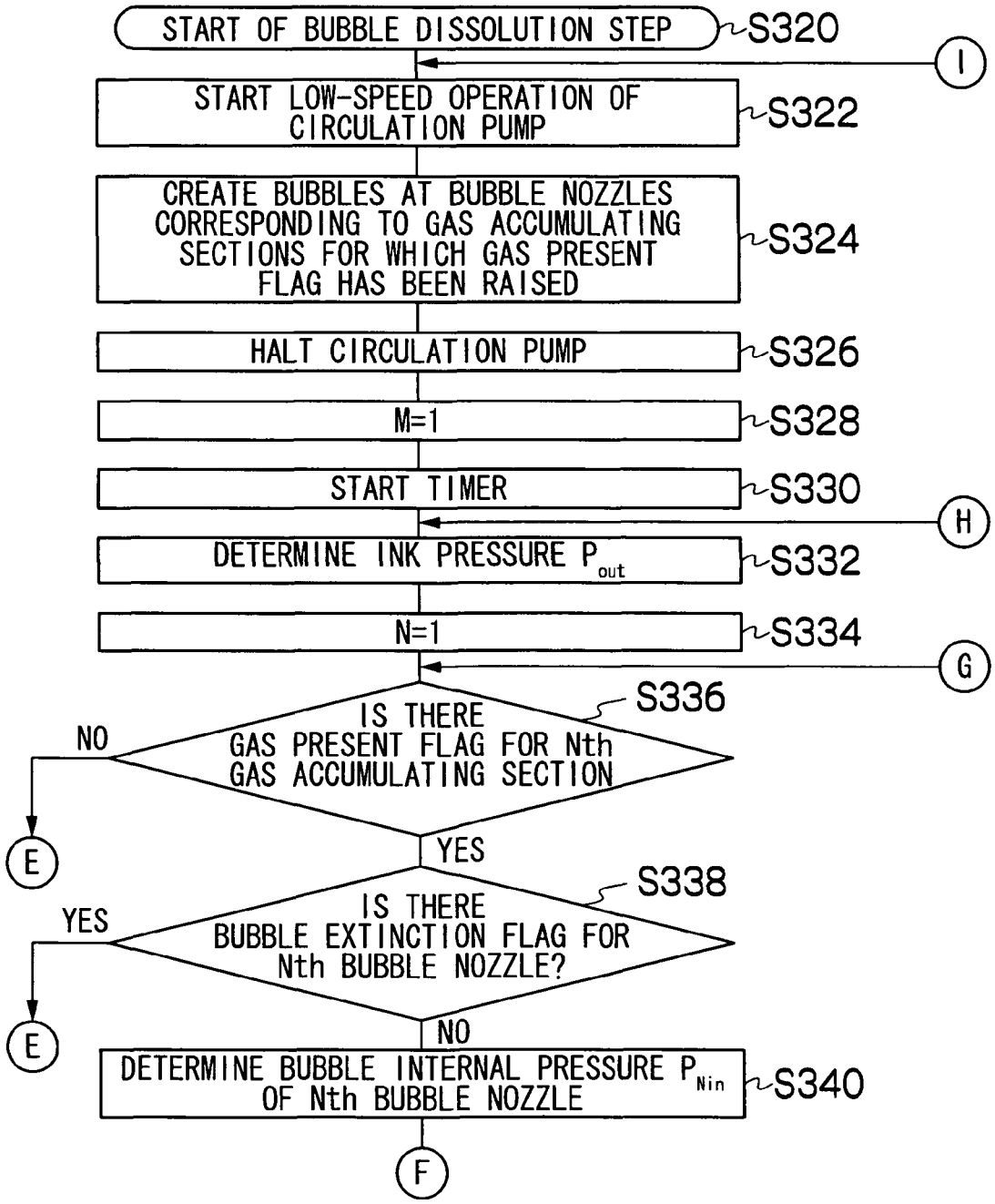
FIGS. 19 and 20 are flowcharts of the bubble dissolution step shown in FIG. 13.

Next, the gas (bubble) dissolution step shown in step S20 in FIG. 13 will be described with reference to FIGS. 19 and 20. As shown in FIG. 19, when the bubble dissolution step is started (step S320), the circulation pump 120 is operated at low speed (step S322), gas accumulating sections 100 corresponding to the gas present flags are identified, and the gas flow channel valves 108 of these gas accumulating sections 100 for which the gas present flags have been established are opened, bubbles are created at the bubble nozzles 105 corresponding to those gas accumulating sections 100 where the gas present flags have been raised (step S324), and the circulation pump 120 is then halted (step S326).

If there are a plurality of gas accumulating sections 100 for which the gas present flags have been established, then the bubbles 142 having the same diameter are created respectively at the bubble nozzles 105 corresponding to the respective gas accumulating sections 100, resulting in the simplification of the control of the gas flow channel valves 108 when creating the bubbles (for example, the opening and closing of the plurality of gas flow channel valves 108 can be controlled simultaneously). Moreover, as described previously, it is desirable that the bubbles created at step S324 be small in size.

Thereupon, 1 is substituted for the sample number M (i.e., M=1) (step S328), the timer count is started (step S330), and the pressure value $P_{out}$ of the ink inside the gas expulsion chamber 104 is measured (step S332).

Next, 1 is substituted for N of the gas accumulating section number (bubble nozzle number) (i.e., N=1) (step S334), and it is judged whether or not a gas present flag has been established for that gas accumulating section 100 (step S336). If the gas present flag has not been established for the Nth (=1st) gas accumulating section 100 (NO verdict), then the procedure advances to step S346 in FIG. 20. If, on the other hand, the gas present flag has been established for the Nth gas accumulating section 100 at step S336 in FIG. 19 (YES verdict), then it is judged whether or not the bubble at the Nth bubble nozzle 105 has been extinguished, in other words, whether or not a bubble extinction flag (see FIG. 23) has been established for the Nth bubble nozzle 105 (step S338 in FIG. 19).

Figure 20:
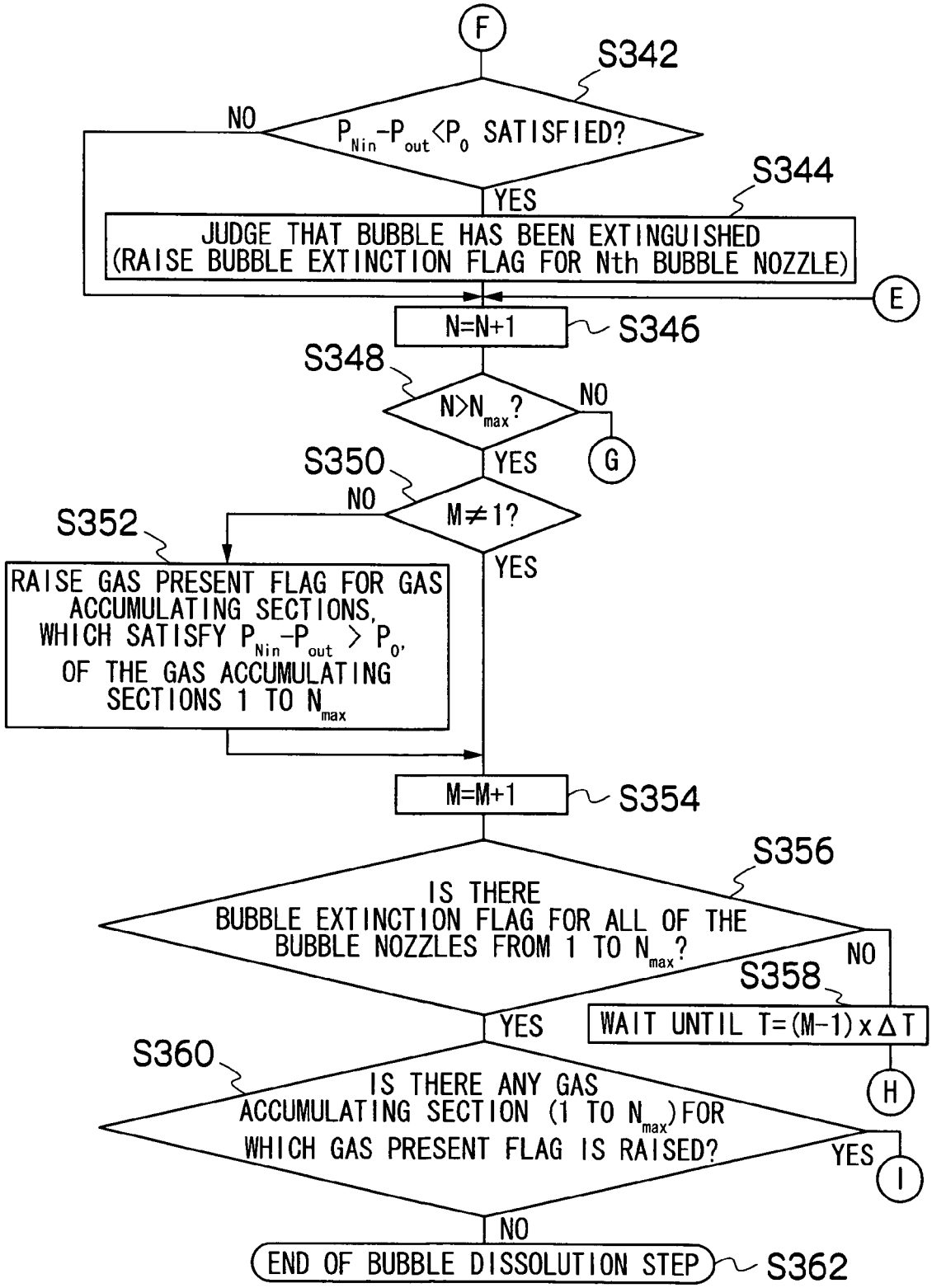

At step S338, if a bubble extinction flag is established for the Nth bubble nozzle 105 (YES verdict), then the procedure advances to step S346 in FIG. 20, and if the bubble extinction flag has not been established for the Nth bubble nozzle 105 (NO verdict), then the internal pressure value $P_{Nin}$ of the bubble at the Nth bubble nozzle 105 is measured (step S340 in FIG. 19).

After the internal pressure value $P_{Nin}$ of the bubble at the Nth bubble nozzle 105 has been measured, it is judged whether or not the relationship of $P_{Nin}-P_{out}<P_0$ is satisfied (step S342), and if the relationship of $P_{Nin}-P_{out}\geqq P_0$ is satisfied, in other words, if it is judged that the bubble has not been extinguished (NO verdict), then the procedure advances to step S346 in FIG. 20, whereas if the relationship of $P_{Nin}-P_{out}<P_0$ is satisfied, in other words, if it is judged that the bubble has been extinguished (YES verdict), then a bubble extinction flag is raised for the Nth bubble nozzle 105 (step S344).

Thereupon, N+1 is substituted for the bubble nozzle number N (i.e., N=N+1) (step S346), and it is judged whether or not processing has been carried out for all of the bubble nozzles 105, from 1 to $N_{max}$, (whether or not the relationship of $N>N_{max}$ is satisfied) (step S348). If there is a bubble nozzle 105 for which processing has not been carried out, in other words, if $N\leqq N_{max}$ (NO verdict), then the procedure advances to step S336 in FIG. 19 and the above-described steps are repeated for the unprocessed bubble nozzle 105, whereas if the processing has been carried out for all of the bubble nozzles 105 from 1 to $N_{max}$, in other words, if the relationship of $N>N_{max}$ is satisfied (YES verdict), then the procedure advances to step S350 in FIG. 20.

At step S350, it is judged whether the sampling operation is the first sampling operation or not, and if it is the first sampling operation (NO verdict), a gas present flag is established for the gas accumulating section 100 where the gas is judged to be present at step S342 (step S352), and the procedure then advances to step S354. The gas present flag of the gas accumulating section 100 established at step S352 is valid in the processing from step 352 onwards. If, on the other hand, it is the second or subsequent sampling operation (YES verdict), then the procedure advances to step S354, and M+1 is substituted for the sample number M (i.e., M=M+1).

Thereupon, it is judged whether or not the bubble has been extinguished, at all of the bubble nozzles 105 from 1 to $N_{max}$, in other words, whether or not a bubble extinction flag has been established for all of the bubble nozzles 105 from 1 to $N_{max}$ (step S356), and if there is a bubble nozzle 105 for which the bubble extinction flag has not been established (NO verdict), then the process waits until the next sample timing T ($=(M-1)\times\Delta T$) (step S358), and the procedure advances to step S332 in FIG. 19.

On the other hand, if it is judged at step S356 in FIG. 20 that the bubbles have been extinguished at all of the bubble nozzles 105 from 1 to $N_{max}$, in other words, that the bubble extinction flags have been established for all of the bubble nozzles 105 from 1 to $N_{max}$ (YES verdict), then it is judged whether or not the gas has been extinguished in all of the gas accumulating sections 100 from 1 to $N_{max}$, in other words, whether the gas present flag is no longer raised for all of the gas accumulating sections 100, from 1 to $N_{max}$ (step S360).

At step S360, if there is a gas accumulating section 100 for which the gas present flag is still raised (NO verdict), then the procedure advances to step S322 in FIG. 19, and the gas (bubble) dissolution step is repeated. On the other hand, if at step S360 in FIG. 20 it is judged that the gas present flag is no longer raised for any of the gas accumulating sections 100 from 1 to $N_{max}$ (in other words, that the gas has been extinguished at all of the gas accumulating sections 100 from 1 to $N_{max}$) (YES verdict), then the gas (bubble) dissolution step ends (step S362).

Since the internal pressure variation that occurs in the print head 50 during the bubble creation step, the bubble internal pressure determination step and the gas (bubble) dissolution step according to the present embodiment, is of a level which does not affect ink ejection, then it is possible to carry out the bubble creation step, the bubble internal pressure determination step and the gas (bubble) dissolution step, during a printing operation. Consequently, it is possible to avoid ejection abnormalities caused by the gas (bubbles), during printing.

Deaeration Step

Figure 21:
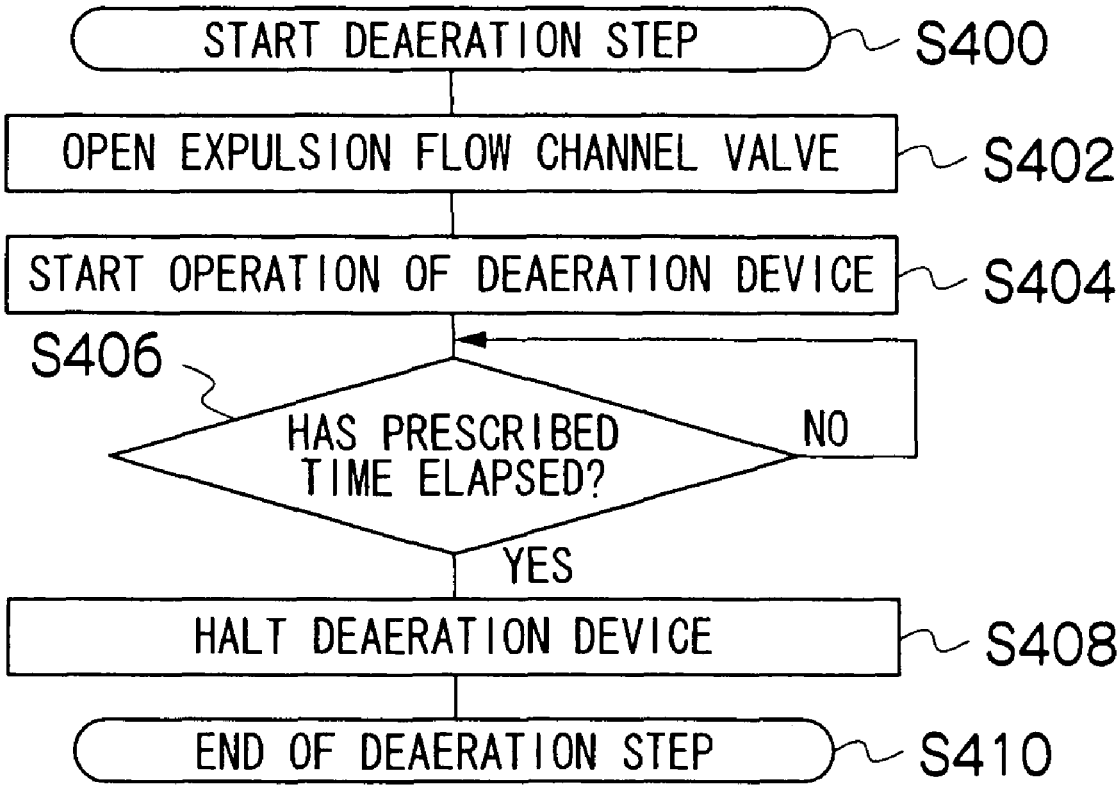
FIG. 21 is a flowchart of the deaeration step shown in FIG. 13.

Next, the deaeration step shown in step S22 in FIG. 13 will be described with reference to FIG. 21. As shown in FIG. 21, when the deaeration step is started (step S400), the expulsion flow channel valve 122 shown in FIG. 5 is opened, the circulation pump 120 is operated, and the ink inside the gas expulsion chamber 104 is thereby sent to the deaeration device 124 (step S402 in FIG. 21). Moreover, the ink movement flow channel valve 114 is opened, and new ink is introduced from the common liquid chamber 55 into the gas expulsion chamber 104.

Next, the deaeration device 124 shown in FIG. 5 is operated, the ink expelled from the gas expulsion chamber 104 is subjected to deaeration processing (step S404 in FIG. 21), and it is judged whether or not the prescribed time period has elapsed (step S406). If at step S406 it is judged that the prescribed time period has not elapsed (NO verdict), then the counting of the elapsed time is continued. On the other hand, if it is judged at step S406 that the prescribed time period has elapsed (YES verdict), then the deaeration device 124 is halted, and furthermore, the deaerated ink is circulated to the ink supply tank 60 shown in FIG. 7 (step S408), whereupon the deaeration step ends (step S410).

Next, the contents stored in the bubble memory 206 shown in FIG. 12 will be described. FIG. 22 is a diagram showing an example of the structure of the data table for the measurement value $P_{Nin}$ of the internal pressure of the bubble and the measurement value $P_{out}$ of the ink pressure, as measured by the bubble pressure sensor 110 and the liquid pressure sensor 111. As shown in FIG. 22, the measurement value $P_{Nin}$ of the internal pressure of the bubble is associated with the number N of the bubble nozzle 105 and the sampling number M, the measurement value $P_{out}$ of the ink pressure is associated with the sampling number M, and the measurement value $P_{Nin}$ of the internal pressure of the bubble and the measurement value $P_{out}$ of the ink pressure are stored as a set in the bubble memory 206.

Furthermore, FIG. 23 is a diagram showing an example of stored gas present flags which are assigned to the gas accumulating sections 100 and are used in the bubble internal pressure determination step (step S16 in FIG. 13) and the gas (bubble) dissolution step (step S20 in FIG. 13), and the bubble extinction flags which are assigned to the bubble nozzles 105 and are used in the gas (bubble) dissolution step. In the gas (bubble) dissolution step, the data table shown in FIG. 23 is updated occasionally, when the presence or absence of gas in the gas accumulating sections 100 and the presence or absence of the bubbles (i.e., whether or not the bubble in the bubble nozzle 105 has been extinguished) in the bubble nozzles 105 are judged in the gas (bubble) dissolution step.

The inkjet recording apparatus having the composition described above has a print head 50 having a gas expulsion chamber 104 provided with bubble nozzles 105 formed in the bottom surface thereof, the gas expulsion chamber being separated from the common liquid chamber 55 by means of a partition 102 and being located on the upper side of the common liquid chamber 55 in the vertical direction. The inkjet recording apparatus includes the print head 50 having a structure in which the common liquid chamber 55 and the bubble nozzles 105 of the gas expulsion chamber 104 are connected through gas flow channels 106. In the inkjet recording apparatus, the gas inside the common liquid chamber 55 is moved to the gas expulsion chamber 104, and a bubble having a prescribed size is thereby created inside or in the vicinity of the bubble nozzles 105. The internal pressure of the bubble is measured by means of a bubble pressure sensor 110 provided inside the gas expulsion chamber 104, and the presence or absence of gas inside the common liquid chamber 55 is judged according to this measurement result. Therefore, it is possible to determine gas inside the print head 50 even in the case where no gas determination device, such as a dissolved oxygen meter, or the like, is provided outside of the print head 50. Moreover, consumables (such as electrolyte) which are necessary in a dissolved oxygen meter are not included in the gas determination device usable for the present invention, and hence the system is maintenance-free.

If there is gas inside the common liquid chamber 55, then the gas inside the common liquid chamber 55 is divided up (into small bubbles) and moved into the gas expulsion chamber 104, in addition to which the gas (small bubbles) is dissolved into the ink inside the gas expulsion chamber 104, and therefore, in comparison with a case where preliminary ejection and circulation are carried out in order to remove gas (bubbles) from the print head 50, no wasted ink is generated due to removal of the gas, and moreover the gas can be removed from the print head 50 during a print operation.

Moreover, if a structure is adopted in which a gas accumulating section 100 which collects and accumulates the gas (bubbles) in the common liquid chamber 55 is provided in the ceiling face of the common liquid chamber 55, and the uppermost portion of the gas accumulating section 100 is connected to the gas flow channel 106, then the position at which the gas is present inside the common liquid chamber 55 is limited to the gas accumulating section(s) 100, and it is possible to judge the presence or absence of gas and to remove the gas, with good efficiency.

Since the ink movement flow channel 112 which moves ink from the common liquid chamber 55 to the gas expulsion chamber 104 and the expulsion flow channel 118 which expels the ink from the gas expulsion chamber 104 to the exterior of the print head 50 are provided, and since the deaeration device 124 is connected to the expulsion flow channel 118, then if the concentration of dissolved gas in the common liquid chamber 55 is calculated on the basis of the internal pressure of the bubble and the concentration of dissolved gas thus calculated exceeds a prescribed reference value, then the ink in the common liquid chamber 55 and the gas expulsion chamber 104 (namely, all of the ink in the print head 50) can be expelled to the exterior of the head and be subjected to deaeration processing.

Furthermore, since the circulation flow channel is provided which circulates the deaerated ink from the deaeration device 124 to the ink supply tank 60, it is possible to reuse the deaerated ink.

In the above-described embodiment, the gas flow channel valve 108 provided in the gas flow channel 106 is opened and closed so as to function as a device for dividing up the gas inside the common liquid chamber 55, whereby a prescribed volume of bubble (small bubble) is moved from the common liquid chamber 55 to the gas expulsion chamber 104 at prescribed time intervals. However, it is also possible to create a plurality of small bubbles at the same time by passing the gas through a filter having a fine mesh, which is provided separately from the bubble nozzle 105, and hence the dissolution speed can be improved.

In the above-described embodiment, the gas expulsion chamber 104 is provided on the upper side of the gas accumulating sections 100 provided in the common liquid chamber 55, in the vertical direction, but it is also possible to move the bubble (gas) in parallel fashion in the horizontal direction, by providing the gas accumulating sections 100 and the gas expulsion chamber 104 at substantially the same height in the vertical direction. In a mode where the gas accumulating sections 100 and the gas expulsion chamber 104 are provided at substantially the same height in the vertical direction, the bubble nozzle 105 is formed at a position which makes contact with the liquid inside the gas expulsion chamber 104.

Furthermore, it is also possible to form at least the peripheral portion of the bubble nozzle 105 from a optical transparency material, and to determine the presence or absence of a bubble (gas) and the speed of dissolution of the gas (bubble), from the exterior of the print head 50, by using an image determination device, such as an imaging apparatus.

The embodiments of the present invention described above according to the inkjet recording apparatus 10 which forms color images on the recording paper 16 by ejecting liquid ink droplets onto the recording paper 16, but the scope of application of the present invention is not limited to an inkjet recording apparatus, and it may also be applied to a liquid ejection apparatus which ejects other types of liquid, such as water, liquid chemicals, treatment liquid, and the like, from ejection holes (nozzles) provided in a head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an ejection head which includes: pressure chambers storing liquid; nozzles which are connected with the pressure chambers and from which the liquid is ejected by means of pressure applied to the pressure chambers; a first liquid chamber which supplies the liquid to the pressure chambers; a gas flow channel which has a first end connected to an upper portion of the first liquid chamber and which forms a flow channel for gas to be expelled from the first liquid chamber; a second liquid chamber which accommodates the liquid and is separated from the first liquid chamber by means of a partition and which has a bubble nozzle connecting to a second end of the gas flow channel other than the first end, the gas being expelled from the first liquid chamber through the gas flow channel and the bubble nozzle and being to be dissolved into the liquid accommodated in the second liquid chamber; a gas flow channel opening and closing device which opens and closes the gas flow channel so that the gas moves from the first liquid chamber to the second liquid chamber; and a bubble pressure measurement element which is provided so as to correspond to a bubble creation position located in a vicinity of the bubble nozzle or inside the bubble nozzle;

a pressure control device which controls internal pressures of the ejection head in such a manner that an internal pressure of the second liquid chamber is less than an internal pressure of the first liquid chamber;

a gas flow channel opening and closing control device which controls the gas flow channel opening and closing device so that a bubble having a prescribed size is created at the bubble creation position, the bubble pressure measurement element measuring an internal pressure of the bubble present at the bubble creation position; and a gas judgment device which judges presence or absence of the gas in the first liquid chamber, according to a measurement result of the bubble pressure measurement element, wherein if the gas is judged by the gas judgment device that the gas is present in the first liquid chamber, then the gas flow channel opening and closing control device controls the gas flow channel opening and closing device so that the gas moves from the first liquid chamber to the second liquid chamber and is dissolved into the liquid accommodated in the second liquid chamber.

2. The liquid ejection apparatus as defined in claim 1, further comprising:

a liquid movement flow channel which connects the first liquid chamber with the second liquid chamber and forms a flow channel for the liquid from the first liquid chamber to the second liquid chamber; and a movement flow channel opening and closing device which opens and closes the liquid movement flow channel.

3. The liquid ejection apparatus as defined in claim 1, wherein, if the gas is judged by the gas judgment device that the gas is present in the first liquid chamber, then the gas flow channel opening and closing control device repeatedly opens and closes the gas flow channel opening and closing device, thereby dividing up the gas present in the first liquid chamber so that the divided gas moves from the first liquid chamber to the second liquid chamber and is dissolved into the liquid accommodated in the second liquid chamber.

4. The liquid ejection apparatus as defined in claim 1, further comprising:

a bubble internal pressure storage device which stores the internal pressure of the bubble measured by the pressure measurement element;

a bubble change history calculation device which converts the internal pressure of the bubble stored in the bubble internal pressure storage device into a diameter of the bubble, and calculates a bubble change history which is a relationship between passage of time and change in the diameter of the bubble;

a dissolved gas concentration calculation device which calculates concentration of dissolved gas in the liquid accommodated in the second liquid chamber, according to the bubble change history calculated by the bubble change history calculation device; and an expulsion device which expels the liquid in the ejection head to an exterior of the ejection head, when the concentration of dissolved gas in the second liquid chamber as calculated by the dissolved gas concentration calculation device exceeds a prescribed threshold concentration value.

5. The liquid ejection apparatus as defined in claim 4, further comprising:

a deaeration device which carries out deaeration processing for the liquid expelled from the ejection head; and a circulation device which circulates the liquid having been subjected to the deaeration processing by the deaeration device, to the ejection head.

6. The liquid ejection apparatus as defined in claim 1, wherein:

the first liquid chamber has a gas accumulating section in the upper portion of the first liquid chamber;

a ceiling of the first liquid chamber is higher at the gas accumulating section than at other portions of the first liquid chamber; and the first liquid chamber is connected to the gas flow channel at an uppermost portion of the gas accumulating section.

7. The liquid ejection apparatus as defined in claim 6, wherein the ceiling of the first liquid chamber is inclined at the gas accumulating section.

8. A gas processing method for a liquid ejection apparatus including an ejection head having: nozzles which eject liquid; pressure chambers connected to the nozzles; a first liquid chamber which supplies the liquid to the pressure chambers; a gas flow channel which has a first end connected to an upper portion of the first liquid chamber and which forms a flow channel for gas to be expelled from the first liquid chamber; and a second liquid chamber which accommodates the liquid and is separated from the first liquid chamber by means of a partition and which has a bubble nozzle connecting to a second end of the gas flow channel other than the first end, the gas being expelled from the first liquid chamber through the gas flow channel and the bubble nozzle and being to be dissolved into the liquid accommodated in the second liquid chamber, the gas processing method comprising the steps of:

controlling internal pressures of the ejection head in such a manner that an internal pressure of the second liquid chamber is less than an internal pressure of the first liquid chamber;

creating a bubble of a prescribed size at a bubble creation position located in a vicinity of the bubble nozzle or inside the bubble nozzle;

measuring an internal pressure of the bubble created in the step of creating the bubble;

judging presence or absence of the gas in the first liquid chamber, according to a measurement result in the step of measuring the internal pressure of the bubble; and moving the gas from the first liquid chamber to the second liquid chamber so that the gas is dissolved into the liquid accommodated in the second liquid chamber, if the gas is judged, in the step of judging the presence or absence of the gas, that the gas is present in the first liquid chamber.

* * * * *